US006245680B1

(12) United States Patent
Shendon et al.

(10) Patent No.: US 6,245,680 B1
(45) Date of Patent: Jun. 12, 2001

(54) CIRCUMFERENTIALLY OSCILLATING CAROUSEL APPARATUS FOR SEQUENTIALLY PROCESSING SUBSTRATES FOR POLISHING AND CLEANING

(75) Inventors: Norm Shendon, San Carlos; William R. Bartlett, Los Gatos, both of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/670,611

(22) Filed: Sep. 26, 2000

Related U.S. Application Data

(63) Continuation of application No. 09/360,532, filed on Jul. 26, 1999, now Pat. No. 6,136,715, which is a continuation of application No. 08/549,607, filed on Oct. 27, 1995, now Pat. No. 5,951,373.

(51) Int. Cl.[7] ..... H01L 21/00
(52) U.S. Cl. ..... 438/692; 156/345; 438/745
(58) Field of Search ..... 438/690, 691, 438/692, 745; 216/38, 88, 89; 156/345 L, 345 LP

(56) References Cited

U.S. PATENT DOCUMENTS 5,895,270 * 4/1999 Hempel ..... 438/692

* cited by examiner

*Primary Examiner*—William Powell
(74) *Attorney, Agent, or Firm*—Fish & Richardson

(57) ABSTRACT

A polishing apparatus including a plurality of polishing pads on respective rotating platens. The polishing platens, and therefore the attached pads also, may be of substantially different diameters. Multiple wafer heads can simultaneously polish multiple wafers on the multiple polishing pads or at different positions on one of the pads. The wafer heads are suspended from a rotatable carousel, which provides positioning of the heads relative to the polishing surfaces. Additionally, a loading/unloading station is provided. The carousel selectively positions the heads on the polishing surfaces, or positions one of the heads over the loading/unloading station while the remaining heads are located over polishing stations for substrate polishing, at which positions the wafers can be polished. The carousel can rotate to sweep all wafer heads attached thereto over respective polishing pads that they overlie.

22 Claims, 27 Drawing Sheets

CIRCUMFERENTIALLY OSCILLATING CAROUSEL APPARATUS FOR SEQUENTIALLY PROCESSING SUBSTRATES FOR POLISHING AND CLEANING

RELATED APPLICATION

This application is a continuation of U.S. application Ser. No. 09/360,532, filed Jul. 26, 1999, now U.S. Pat. No. 6,136,715, which is a continuation of U.S. application Ser. No. 08/549,607, filed Oct. 27, 1995, now U.S. Pat. No. 5,951,373.

FIELD OF THE INVENTION

The present invention in general relates to substrate polishing apparatus, wherein the surface of a substrate is positioned against a polishing surface such that relative motion between the substrate surface being polished and the polishing surface causes the substrate to be polished. In particular, the invention relates to a substrate polishing apparatus in which a substrate is polished at multiple polishing stations in a progressive polishing sequence.

BACKGROUND OF THE INVENTION

Electronic integrated circuit devices are typically formed on substrates, most commonly on semiconductor substrates, by the sequential deposition and etching of conductive, semiconductive and insulative film layers. As the deposition layers are sequentially deposited and etched, the uppermost surface of the substrate, i.e., the exposed surface of the uppermost layer on the substrate, becomes progressively more non-planar. This occurs because the height of the uppermost film layer, i.e., the distance between the outer surface of that layer and the surface of the underlying substrate, is greatest in regions of the substrate where the least etching has occurred, and least in regions where the greatest etching has occurred.

This non-planar surface presents a problem for the integrated circuit manufacturer. The etching step typically includes depositing a photo-resist layer on the exposed surface of the substrate, and then selectively removing portions of the resist bay a photolithographic process to provide the etch pattern on the layer. If the layer is non-planar, photolithographic techniques of patterning the resist might not be suitable because the surface of the substrate may be sufficiently non-planar to prevent focusing of the photographic apparatus on the entire layer surface. Therefore, a need exists to periodically planarize the substrate surface to restore a planar layer surface for photolithography.

Polishing is also usable in a fabrication process in which a metal layer is defined into metal lines with narrow spaces between. A thick silicon oxide layer is then deposited to fill the spaces but to also overfill so as to produce an oxide layer overlying the metal lines, with a oxide layer having a generally planar top surface. Polishing is then used to remove the silicon oxide down to the metal lines and possibly remove a little more material including both metal and oxide. As a result, this polishing is effectively designed to be a planar process.

Chemical mechanical polishing is one accepted method of planarization. This planarization method typically requires that the substrate be mounted in a wafer polishing head with its surface to be polished exposed at its surface facing the head. The head, wutg the attached substrate, is placed against a rotating polishing pad. The head may also rotate, to provide additional motion between the substrate and the polishing surface. Further, a polishing slurry is supplied to the interface between the pad and the substrate being polished. This slurry typically includes an abrasive and at least one chemically reactive agent therein, which are selected to enhance the polishing of the film layers of the substrate.

The polishing pad provides a surface having specified polishing characteristics. Thus, for any material being polished, the pad and slurry combination are theoretically capable of providing a specified finish and flatness on the polished surface. Typically, the actual polishing pad and slurry combination selected for a given material are based on a trade off between the polishing rate, and therefore the throughput of wafers through the machine, and the need to provide a desired finish and flatness on the substrate on the substrate. Because the flatness and surface finish of the film layer can limit the utility of the substrate in subsequent fabrication steps, the fabricator's selection of a polishing pad and slurry are usually dictated by the needed finish and flatness, and the polishing time is a resulting limitation on the throughput of substrates through the polishing apparatus.

An additional limitation on polishing throughput arises because the polishing material becomes packed with the debris of polishing, and it also becomes compressed in the regions where the substrate was pressed against it for polishing. This condition, commonly referred to as "glazing", causes the polishing surface to become less abrasive, with the result that the polishing time necessary to polish any individual substrate increases. Therefore, the polishing surface must be periodically restored, or conditioned, in order to maintain a high throughput of substrates through the polishing apparatus.

One method of increasing throughput uses a wafer head having a plurality of substrate loading stations therein to simultaneously load a plurality of substrates into the head in opposition to a single polishing pad to enable simultaneous polishing of the substrates on the single polishing pad. Although this method would appear to provide substantial throughput increases over the single-substrate style of polishing head, several factors militate against the use of such carrier arrangements for planarizing substrates, particularly after deposition layers have been formed thereon. First, the head is complex, and, in order to attempt to provide control of the loading of each of the substrates against the pad, a substantial number of moving parts and pressure lines must be provided. Additionally, the control over the polishing of each of the substrates is limited, and is a compromise between individual control and ease of controlling the general polishing attributes of the multiple substrates. Finally, if any one substrate develops a problem, such as if a substrate cracks, the broken piece of the substrate may come loose and destroy all of the substrates.

Therefore, the need exists in the art for a polishing apparatus which enables the optimization of polishing throughput, flatness, and finish while minimizing the risk of contamination or destruction of any substrate.

SUMMARY OF THE INVENTION

The present invention provides a chemical mechanical polishing apparatus and a method of using the apparatus that improves throughput of substrates through the apparatus, and additionally planarizes substrates with improved flatness and surface finish and improved uniformity in the removal rate of material over the surface of the substrate.

In one aspect of the invention, the apparatus includes multiple polishing pads provding different polishing stages for polishing the substrate. In particular, a first polishing pad may provide a high material removal rate and a first finish and flatness on the substrate, and a second or additional polishing pad provides a finer finish and greater flatness on the substrate than possible with the first pad. Alternative, the second polishing pad may provide a different type of polishing, may provide similar polishing in an in-line proces, or provide a cleaning of the substrate surface.

In each aspect of the invention, the substrates to be polished are positioned at the relevant workstation, i.e., polishing surface or cleaning station, by first loading the substrates into a wafer head with the surface to be polished exposed, and then sequentially positioning the substrate on the first polishing pad, the second polishing pad, and then at the cleaning station. Multiple wafer heads are linked to a carousel frame, which then moves the wafer heads, and the substrates therein, from station to station.

The placement of the substrates on the workstations and the duration of polishing or cleaning performed at each workstation are preferably controlled by a controller, such as a microprocessor, which is programmed to direct the positioning and loading of the substrates to provide optimal polishing finish, flatness and throughput.

DETAILED DESCRIPTION OF THE PREFERRED EMBODIMENTS

An Overview of the Apparatus

Figure 1:
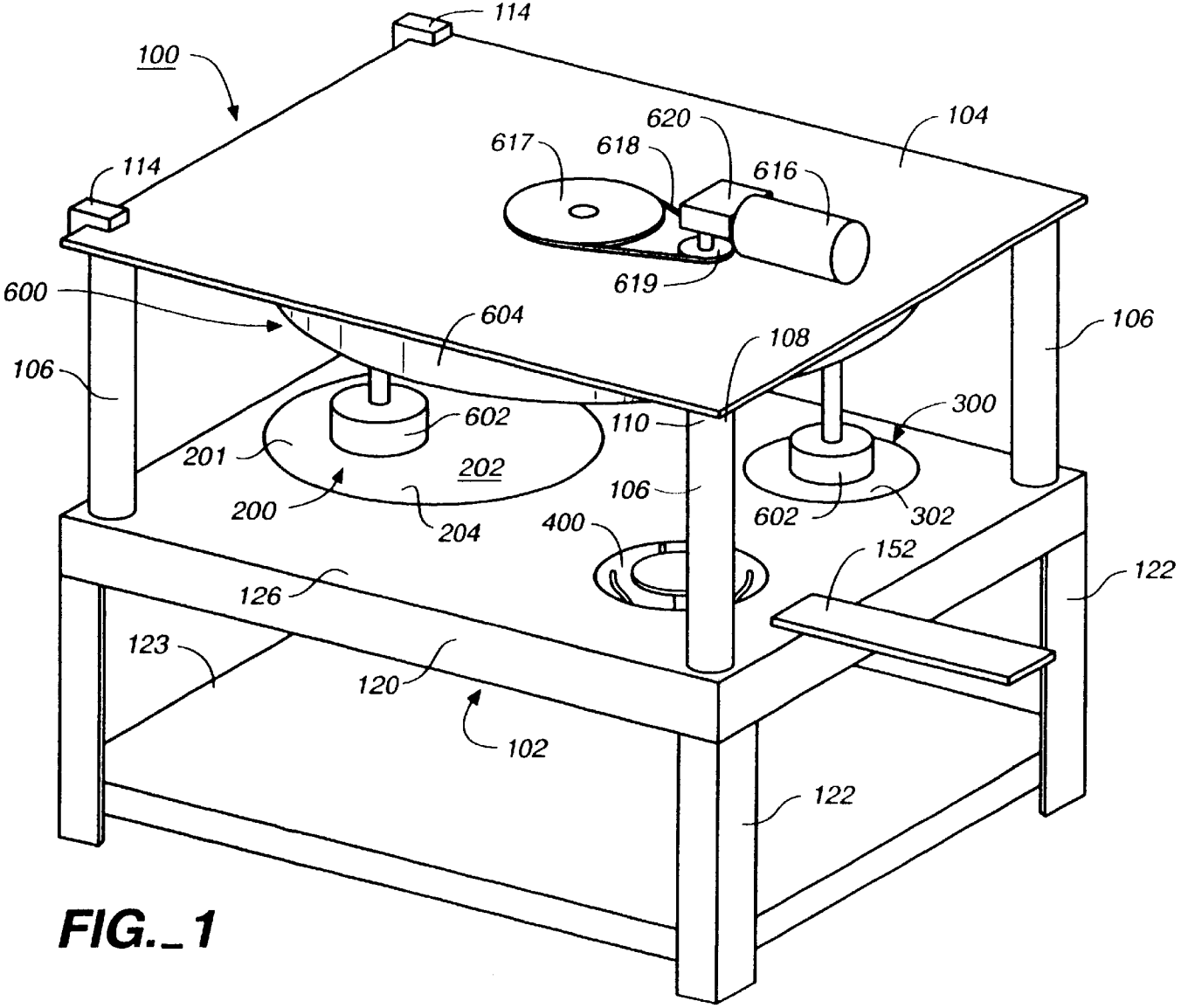
FIG. 1 is a perspective view of a polishing apparatus of the present invention.
Figure 2:
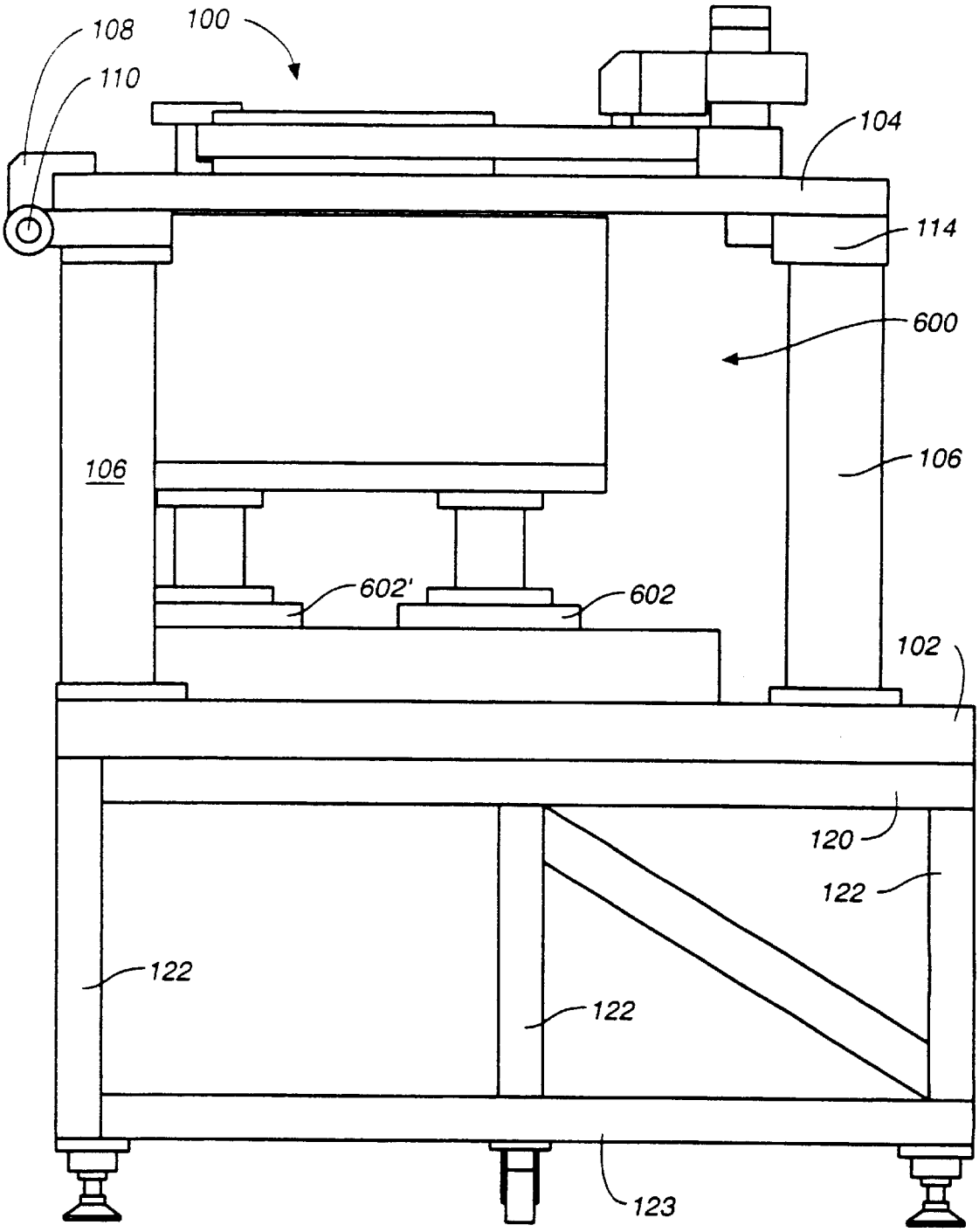
FIG. 2 is an end view of the polishing apparatus of FIG. 1.

FIGS. 1 and 2 show a first embodiment of an integrated polishing apparatus 100 of the invention which includes a plurality of sub-systems therein useful for polishing and cleaning substrates to provide a planarized substrate with minimal residual particulate matter. In this embodiment of the invention, the sub-systems include a first polishing station 200, a second polishing station 300, a loading and unloading station 400, and a substrate positioning assembly 600. In use, individual substrates 10 are loaded into individual wafer heads 602, 602' of the apparatus, and are sequentially polished on the two polishing stations 200, 300. After polishing, the substrates 10 are unloaded from the apparatus 100 at the loading and unloading station 400, and a new substrate is placed into the wafer head 602 or 602'.

Preferably, the polishing apparatus 100 allows simultaneous polishing by one of the heads and washing, loading or unloading of substrates from the other of the heads at the loading and unloading station 400. Additionally, each of the heads 602, 602' may be positioned to polish the substrate therein on one or the other of the polishing stations 200, 300 as shown in FIG. 1.

Assembly Structure

To support the various sub-systems of the invention, the polishing apparatus 100 includes a machine base 102, over which an overhead platform 104 is supported on a plurality of, preferably four, posts 106. The posts 106 provide fixed support and locating of the overhead platform 104 relative to the machine base 102. The overhead platform 104 is also preferably rotatable in the vertical direction with respect to the machine base 102 by a hinge bar 108 extending between the ends of adjacent posts 106, and a hinge 100 hingedly connects the overhead platform 104 through that hinge bar 108 to the machine base 102. To secure the overhead platform 104 against movement about the hinge 110, securing members 114 extend between the overhead platform 104 and the posts 106 and clamp them together. Thus, during processing, the overhead platform 104 is rigidly held on the posts 106, but when polishing is not being performed the overhead platform 104 may be hinged upwardly at one end thereof for servicing of the components of the polishing apparatus 100, which would otherwise be blocked thereby.

The machine base 102 preferably includes an upper table 120, which is supported by a frame, either a weldment, a casting, or a plurality of, preferably six, legs 122. Each leg 122 provides mechanical support of the table 120 to space the table from a supporting surface, such as a floor. The table 120 preferably includes a plurality of support rail members 123, which provide support for the various sub-systems of the apparatus which are housed in the machine base 102, and it also includes a table top 126 which protects the sub-systems mounted on the machine base 102 from liquids which may be flung off the polishing surfaces or sprayed out of the loading/unloading station 400 during processing. The table top 126 preferably includes four apertures therethrough for providing access of the polishing stations 200, 300, the loading/unloading station 400, and the conditioning apparatus 800 through the table top 126.

THE POLISHING STATIONS

Figure 3:
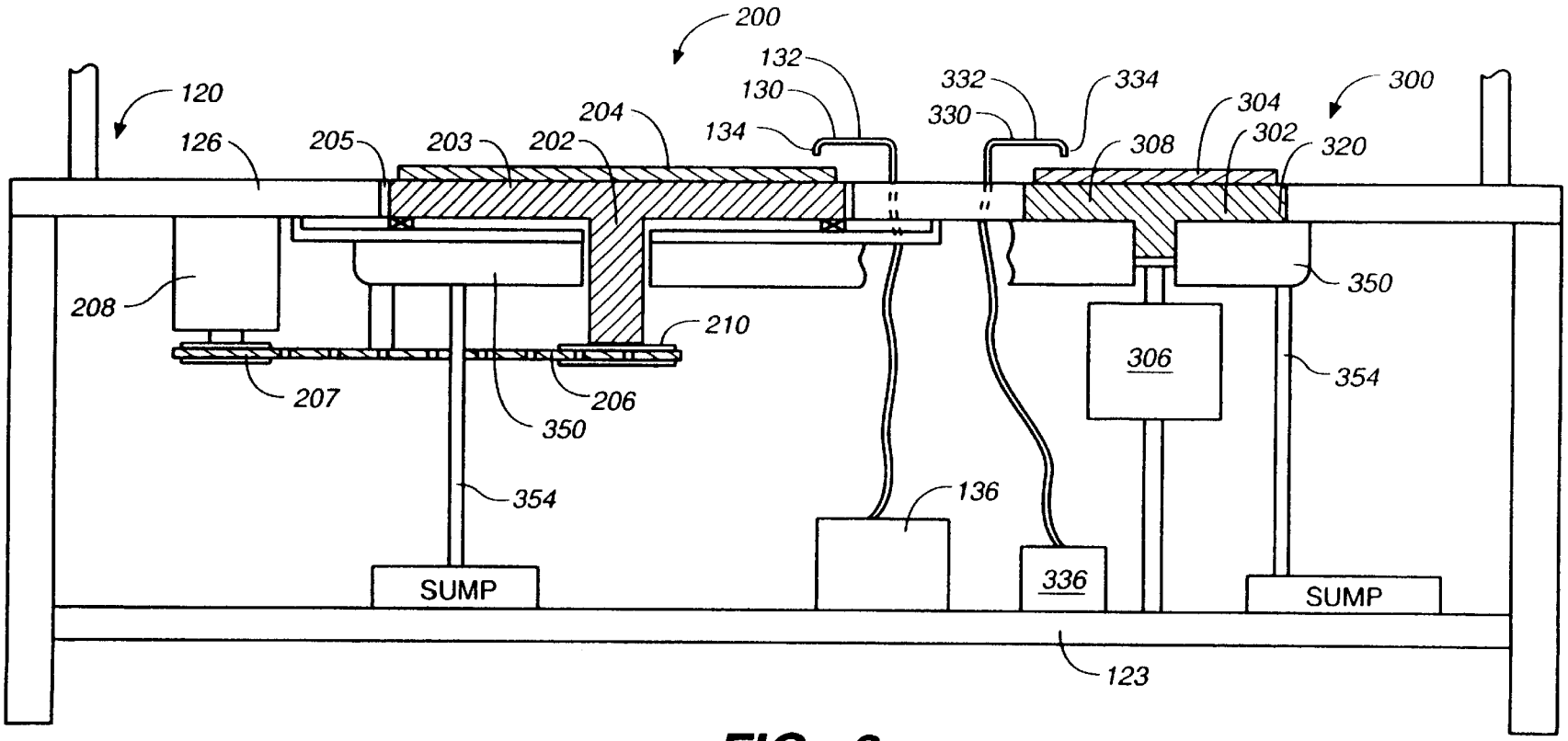
FIG. 3 is a side sectional view of the apparatus of FIG. 1.

FIGS. 1, 2 and 3 show the general structure of each of the polishing stations 200, 300. The polishing stations 200, 300 are substantially identical, except as specifically noted.

The First Polishing Station

The first polishing station 200 is located at an aperture 201 in the table top 126 of the base 102, and supported thereon by a plurality of bolts (not shown) or other fasteners secured to the underside of the machine base 102. The first polishing station 200 includes a platen 202 which extends into the aperture and over which a conformable polishing pad 204 is secured such as with a removable adhesive. Preferably, materials such as Suba, IC-1000, or IC-2000, all available from Rodel of Newark, Del., are used for the pad 204. As shown in the cross section of FIG. 3, the platen 202 includes a planar, pad receiving surface 203 and is separated from the table top 126 by a small annular gap 205. The platen 202 is coupled, through a drive sheave 205 and a pulley or belt 206, to an output sheave 207 of a drive motor 208. The drive motor 208 is secured to the underside of the table top 126. The drive motor 208 provides sufficient torque to rotate the platen 202, and thus the polishing pad 204, at a fixed rotational velocity as it frictionally engages the wafer being processed. The pad 204 preferably is sized to be at least twice the diameter of the substrate or larger.

An overhead slurry port 130 is rotatably supported on the table top 126 adjacent to the aperture 201 to direct a slurry to the exposed surface of the pad 204. The slurry port 130 includes an adjustable dispensing tube 132, such as bellows tubing, which terminates in an orifice 134 overlying the pad 204. It is perhaps preferable that the dispensing tube be mounted on the carousel 604 to be in fixed relation with the wafer head 602 (or 602'). A slurry supply 136, such as a pressurized source of slurry, is connected to the port 130 to provide slurry to the surface of the pad 204.

The Second Polishing Station

Referring still to FIGS. 1, 2 and 3, the second polishing station 300 preferably includes a platen 302, having a second polishing pad 304 thereon, which is rotated by a second drive motor 306 secured to the horizontally extending beams 123. Preferably, the output shaft of the second drive motor 306 is directly coupled to the underside of the smaller platen 302. The second motor 306 provides sufficient torque to drive the platen 302 at a constant velocity as it frictionally engages and polishes the wafer. It is possible that a single motor drives both platens 202, 302.

The platen 302 preferably includes a planar surface 308 on which the polishing pad 304 is received. The pad 304 is preferably sized to be approximately, one and one quarter to two times the diameter of the substrate 10, although it may be larger, and to be approximately the size of the platen 302. That is, the platen 302 of the second polishing station 300 is substantially smaller than the platen 202 of the first polishing station 200. Exemplary dimensions are 13 inches (33 cm) for the smaller platen 302 and 21 inches (53 cm) for the larger platen 202. However, many aspects of the invention are applicable to mulitple platens being of the same size. The polishing station 300 is located immediately adjacent to an aperture 320 in the table top 126, though which the platen 302 may be accessed.

As shown in FIG. 3, a dispensing port 330 located on the table top 126 adjacent to the aperture 320 directs a fluid such as slurry to the exposed surface of the small pad 304. The dispensing port 330 includes an adjustable dispensing tube 332, such as bellows tubing, which terminates in an orifice 334 overlying the pad 304. A fluid supply 336, such as a pressurized source of water, is connected to the dispensing port 330 to provide slurry or other fluid to the surface of the pad 304.

The platens 202, 302 are each received within open basins 350, through the lower termini of which the shaft of the sheave 205 extends to connect the first drive motor 208 to the first platen 202 and of which the motor drive shaft extends to connect the second drive motor 306 and the second platen 302. These basins 350 also include a respective drain line 354 which drains to a sump. The basins collect slurry, or liquids, which drain off of the pad surface to be collected in a sump.

Figure 4:
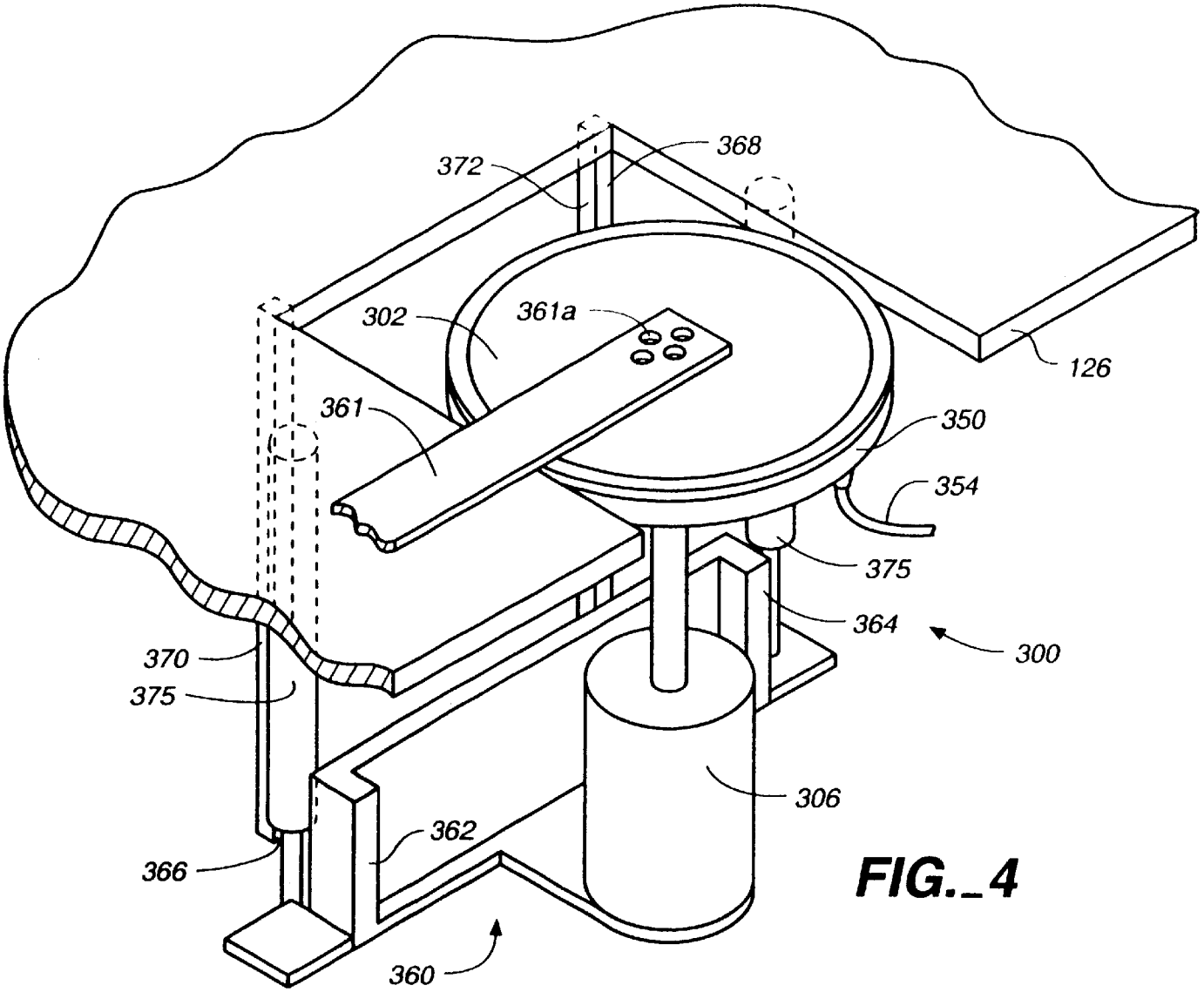
FIG. 4 is a partial perspective view of an alternative embodiment of the apparatus of FIG. 1.

Referring now to FIG. 4, one alternative embodiment of the second polishing station 200 invention is shown wherein the platen 302, the basin 350 and the drive motor 306 are all mounted on a carriage 360 which is vertically movable with respect to the table top 126 of the apparatus. In the extended, or polishing, position, the carriage 360 if the second polishing station 300 is located such that the upper surface of the second platen 302 is located to be substantially co-planar with the upper surface of first platen 202. In a second position, as shown in FIG. 4, the carriage 360 is retracted by hydraulic pistons 375 so that the platen 302 is located approximately one to two inches (2.5 to 5 cm) below the upper surface of the table top 126. In this position, a substrate 10 held in one of the wafer heads 602, 602' positioned over the platen 302 may be sprayed by upwardly directed spray jets 361 a positioned near the end of a spray arm 361 inserted between the table top 126 and the wafer head 602, 602', as is shown in FIG. 4, to enable rinsing of the substrate 10 and the wafer head 602 or 602' over the platen 302 and the basin 350. By rinsing the substrate 10 and the wafer head 602 or 602' (not shown in FIG. 4) over the basin 350, the spent rinse water will collect in the basin 350 and be drained through the flexible drain line 354 to the sump. Additionally, this configuration allows the substrate to be removed from the wafer head 602, 602' at a station which does not also include a cleaning or rinsing portion, thereby reducing the required vertical stroke of the wafer head 602, 602'.

To provide the positioning of the components of the second polishing station 300, the second drive motor 306 is supported by a pair of rails 362, 364, which are mounted, through linear bearing assemblies 366, 368, to a pair of opposed hangers 370, 372 suspended from the table top 126. Additionally, hydraulic pistons 375 link each of the rails 362, 364 to the table top 126, to selectively position the carriage 360 of the second polishing station 300 at the extended or the retracted position.

The Wafer Head Assembly

Figure 5:
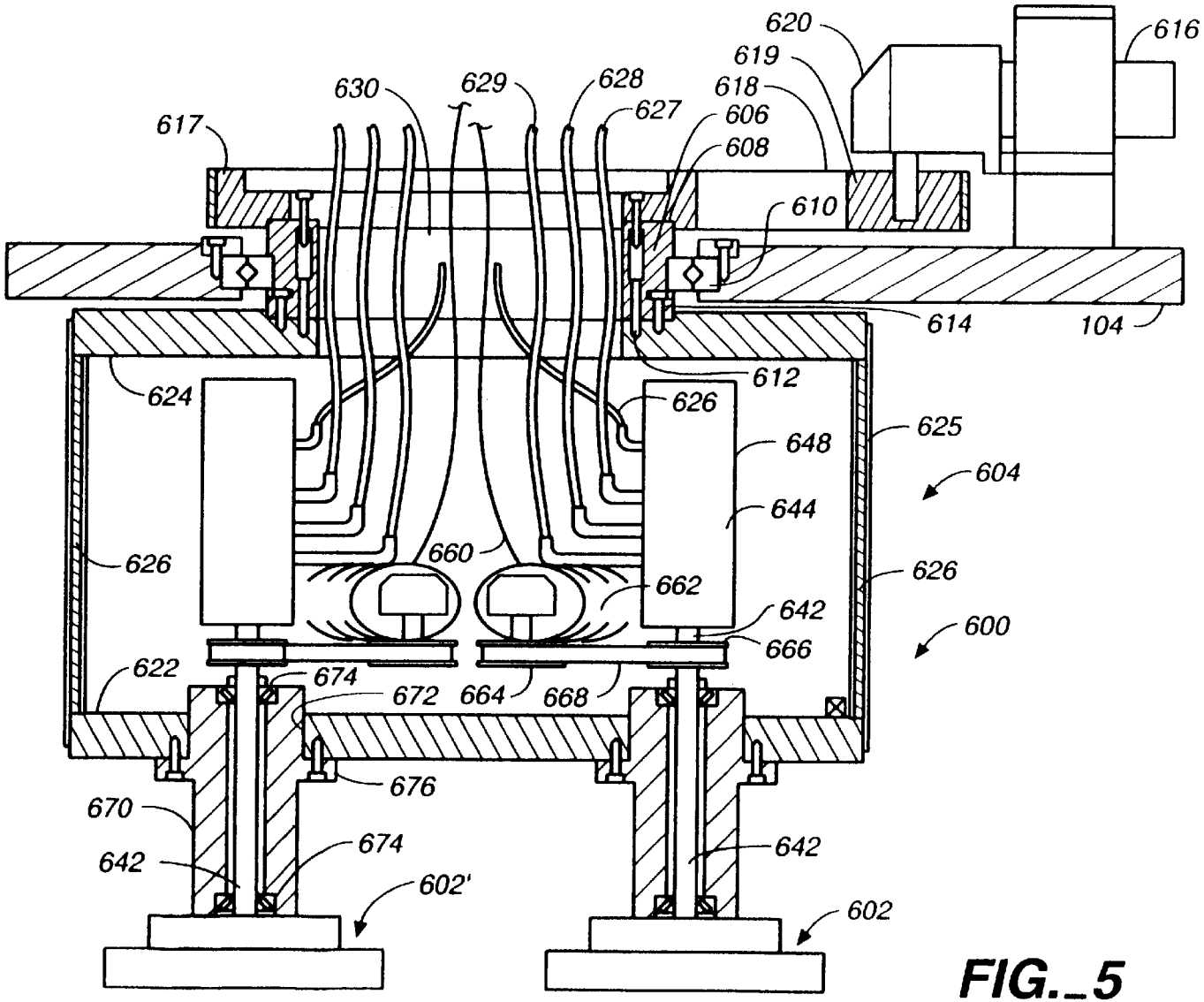
FIG. 5 is a partial view, partially in section, of the carousel assembly including the two polishing heads of the apparatus of FIG. 1.

Referring to FIGS. 1 and 5 the preferred structure of the substrate positioning assembly 600 is shown. This assembly preferably includes a carousel 604, which is suspended from the overhead platform 104, and the aforementioned wafer heads 602, 602' which are suspended from the carousel 604 to selectively position substrates 10 (not shown in these figures) received therein over the polishing pads 204, 304 or over the loading/unloading station 400.

Referring now primarily to FIG. 5, the carousel 604 is rotationally supported from the overhead platform 104 so as to allow positioning of the wafer heads 602, 602' in a circular path across the table top 126 and intersecting the polishing stations 200, 300 and the loading/unloading station 400. This rotatable support is provided by a circular sleeve 606, having an outwardly extending flange 608 thereon, extending through an aperture provided therefor in the overhead platform 104. A rotational bearing 610, such as a roller bearing or a liquid film bearing having an annular profile, is located between the upper surface of the overhead platform 104 and the lower surface of the sleeve flange 608. Thus, the sleeve 606 is rotationally suspended from the overhead platform 104. The lower end of the sleeve 606 includes a carousel flange 612, which is secured to the carousel 604 by a set of bolts 614.

To controllably rotate the carousel 604, a carousel drive motor 616 located on the overhead platform 104, as additionally illustrated in perspective in FIG. 1, is coupled through a drive belt 618 to the sleeve flange 608. The sleeve flange 608 has affixed to its upper end a sleeve pulley 617 or sheave around which is wrapped the belt 618, and the drive motor 616 includes a right-angled drive coupling 620 on its output to drive a pulley 619 driving the belt 618. The drive motor 616 is preferably a stepper motor, which is controlled by the system controller, to move the sleeve flange 608 through approximately 270 degrees of rotation in either a clockwise or a counterclockwise direction, as will be further described herein.

Referring now primarily to FIG. 5, the carousel 604 is preferably configured as a right circular, hollow, utility cabinet within which are enclosed pneumatic or hydraulic feed lines, electrical cables and drive motors for rotating the heads 602, 602'. To complete this cabinet configuration, the carousel includes a base 622, which extends horizontally in parallel to but vertically offset from an upper plate 624, and side sheathing 625 which extends vertically between the upper plate 624 and the base 622. These elements define the boundaries of the cabinet. To provide the rigid spacing between the base 622 and the upper plate 624, a plurality of posts 626 (preferably four) are equally spaced about the perimeter of the base 622 and the upper plate 624 inside the sheathing 625, and the base 622 and upper plate 624 are secured to the posts 626 by bolts extending through the base, or upper plate, and into threaded apertures (not shown) provided therefore in the ends of the posts. To fix this cabinet assembly above the polishing surface, the bolts 614 secure the upper surface of the upper plate 624 to the carousel flange 612. Thus, as the drive motor 616 rotates, the carousel plate 614, and thus the entire cabinet, will rotate in a corresponding direction about a vertical axis. The sheathing 625 protects the utility connections and the drive motors maintained in the cabinet.

FIG. 5 further shows the connections of the utilities to the heads 602. 602'. For ease of understanding, only the feeds required to operate one of the wafer heads, specifically head 602, will be discussed, it being understood that identical feeds are needed to operate the other head 602'. Also, the number and type of feeds depend upon the type and operation of the heads 602, 602', and other head configurations may require different feeds. In the illustrated embodiment of the invention, the feeds include four fluid lines 626, 627, 628 and 629 for pneumatic pressure and for water or other liquid. The lines 626 and 628 are coupled to independent variable pressure sources. The fluid lines 627 and 629 are coupled to water supplies. To extend the fluid lines 626–629 into the carousel 604, the fluid lines 626–629 are routed along the overhead platform 104, and then through the hollow interior portion 630 of the sleeve 606.

The fluid lines 626–629 are connected to the head 602 through corresponding passages in a head drive shaft 642 extending downwardly from the carousel 604, as will be further described herein, and a rotary union 644 is provided over the end of the shaft 642 within the cabinet of the carousel 604. The rotary union 644 includes a cylindrical housing 648, which is sealed over the shaft 642 with multiple seal rings (not shown) to enable the shaft 642 to rotate within the housing 648, but to create four annular sealed chambers (not shown) which are laterally defined between the inner surface of the housing 648 and the outer surface of the shaft 642 received therein and are vertically defined between pairs of annular seal rings. A plurality of bores extend through the head drive shaft 642, and each bore is connected by a side passage to within one of the chambers.

A power cable 660 is required for each head 602, 602' being used. Each terminates within the carousel 604 and is there connected to a respective head drive motor 662. The head drive motor 662 is preferably a variable speed DC motor, which is connected to a horizontally rotating output pulley 664. Each head drive shaft 642 also includes an input pulley 666 thereon, and a drive belt 668 extends between the pulleys 664, 666 to enable the motor 662 to drive the head drive shaft 642 in rotational motion.

To connect the wafer head 602 to the carousel 604, the head drive shaft 642 preferably extends through a bearing retainer 670, which extends through a pilot hole 672 in the base 622 of the carousel 604. Bearings 674 are located between at each end of the retainer 670 to retain the head drive shaft 642 therein, and to enable the shaft 642 to rotate with respect to the carousel base 622 but simultaneously support the head drive shaft 642 in the retainer 670. Preferably, the retainer 670 also includes an annular outwardly extending flange 676 which is bolted to the underside of the carousel bottom plate 622 about the perimeter of the pilot hole 672.

Figure 6:
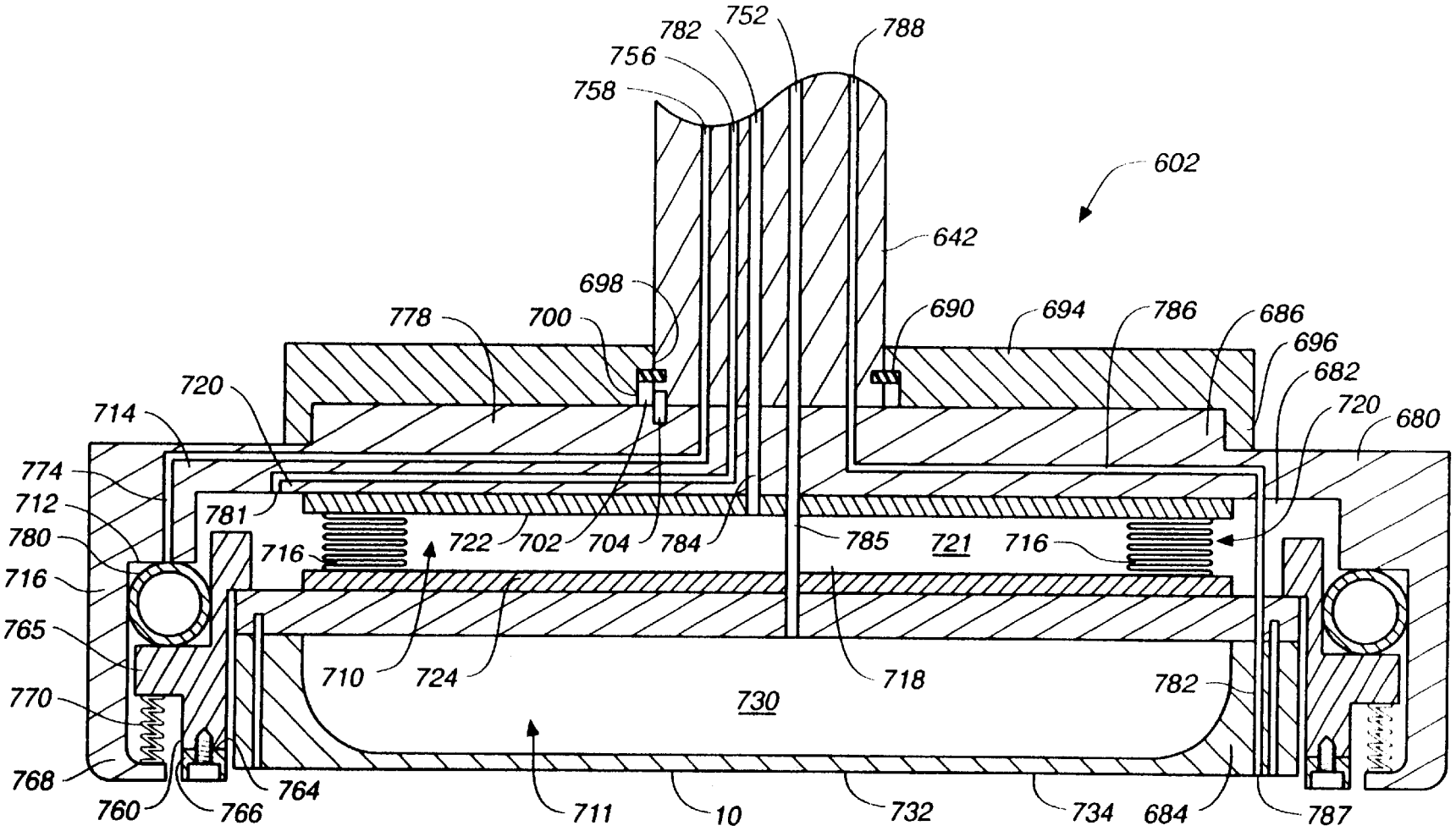
FIG. 6 is a sectional view of a polishing head of the apparatus of FIG. 1.

Referring now to FIG. 6, the internal structure of the wafer head 602 is shown in detail. This head is similar to one described by Shendon in U.S. patent application Ser. No. 08/488,921, filed Jun. 9, 1995. Preferably, the head 602 includes a bowl portion 680 having a downwardly facing recess 682 therein, and within which a carrier plate 684 is received. To connect the head 602 to the head drive shaft 642, the bowl portion 680 includes an upwardly extending, externally threaded, boss 686 and the shaft 642 terminates against the raised boss 684. A cup-shaped perimeter nut 694, having a downwardly extending, internally threaded lip 696 and a central recess 698 secure the head drive shaft 642 to the bowl portion 680. The end of the shaft 642 extends through the recess 698, and a snap ring 690 is placed into a snap ring bore located adjacent to the end of the shaft 642 after the shaft end is extended through the bore 698. The snap ring 690 prevents retraction of the shaft 642 from the bore 698. The cup-shaped perimeter nut 694 is then locked over the boss 686 by threading the lip 696 over the externally threaded surface of the boss 686, thereby trapping the snap ring 690 between the cup-shaped perimeter nut 684 and the bowl portion 680. To rotationally lock the head drive shaft 642 and the bowl portion 680, the shaft 642 includes a keyway 700 extending inwardly of its lower end, and the boss 686 also includes a keyway 702 which aligns with the shaft keyway 700 when the shaft 642 is received in the perimeter nut 696. A key extends between the two keyways 700, 702. Alternatively, a pin may be fit in two matching dowel holes 704 in the boss 688 and the drive shaft 642.

Figure 16:
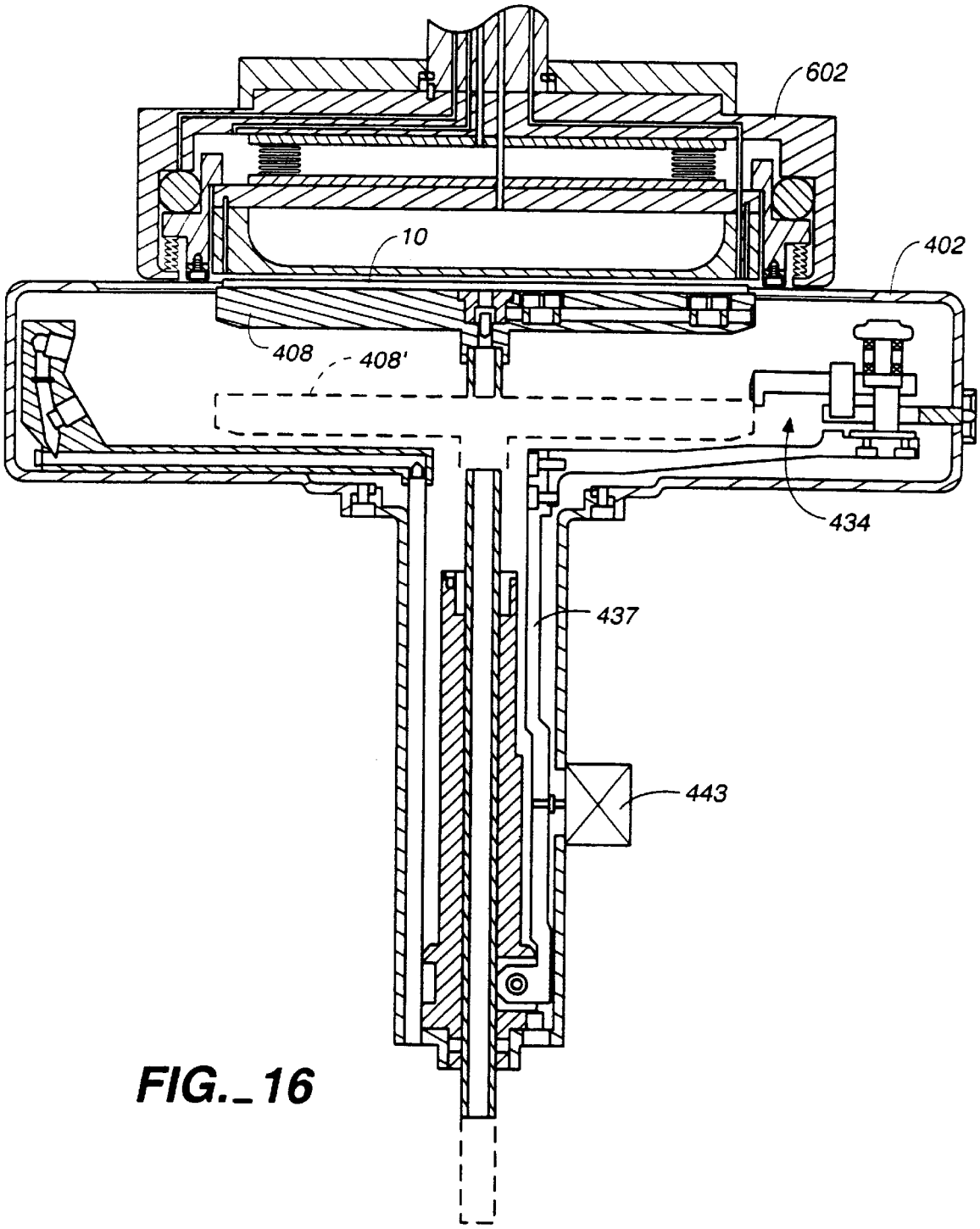

The bowl portion 680 provides a substantially vertically fixed, rotationally movable, reference surface from which the substrate 10 is loaded against the polishing surface. In the preferred embodiment of the invention as shown in FIG. 16, the substrate loading is accomplished by selectively positioning the carrier plate 684 with respect to the reference surface provided by the bowl portion 680 with a primary, upper loading assembly 710 and a secondary, lower loading assembly 711. Preferably, the central recess 682 is defined within the boundaries of the bowl portion 680, which in the preferred embodiment is a one-piece member, having an upper, horizontally extending plate-like portion 714 and a downwardly extending rim 716. The carrier plate 684 is received within the recess 682 and is extendable therefrom to locate a substrate received thereon against a polishing surface.

To enable selective positioning of the carrier plate 684 in the recess 684, the primary loading assembly 710 includes a bellows 716 which extends between the underside of the upper plate 714 and the upper surface of the carrier plate 684. This bellows 716 is sealed at its connection to the carrier plate 684 and the upper plate 714 of the bowl member 680, and these connections are also of sufficient strength to support the mass of the carrier plate 684 hanging from the body portion 680 without separation. Preferably, a bellows cavity 721 is formed within a removable bellows insert 720, which includes an upper bellows plate 722 and a lower bellows plate 724 between which the bellows 716 extend. The bellows 716 are affixed to the plates 722, 724, to create the removable bellows insert 720. To affix the bellows insert 720 to the body portion 680 and to the carrier plate 684, a plurality of unillustrated bolts extend through the rim of the lower bellows plate 724 and into the top of the carrier plate 684, and a plurality of unillustrated bolts extend through the plate-like portion of the bowl portion 680 and into threaded holes in the upper bellows plate 722.

The secondary loading assembly 711 of the wafer head 602 includes a bow chamber 730 which is formed within the carrier plate 684. The bow chamber 730 is a sealable cavity having a thin, generally planar flexible membrane 732 against which a conformable material 734, such as a piece of polishing pad material may be located to form a conformable substrate receiving surface for the surface.

To polish a substrate using the head 602, a substrate is loaded against the material 734 covering the planar surface of the membrane 732. The head is then positioned over one of the polishing pads 204, 304, and the bellows cavity 721 is pressurized to enlarge itself to thereby bias the carrier plate 684 toward the polishing surface and thereby load the substrate against the polishing surface. To vary the pressure between the center and the edge of the substrate, the bow chamber 730 is pneumatically pressurized. Positive pressure will bend the flexible planar membrane 732 outwardly (downwardly), and the center of the planar surface will extend furthest outwardly in a convex structure to increase the loading between the substrate and the pad polishing surface near the center of the substrate. Negative pneumatic pressure, on the other hand, tends to create a concave structure.

Figure 7:
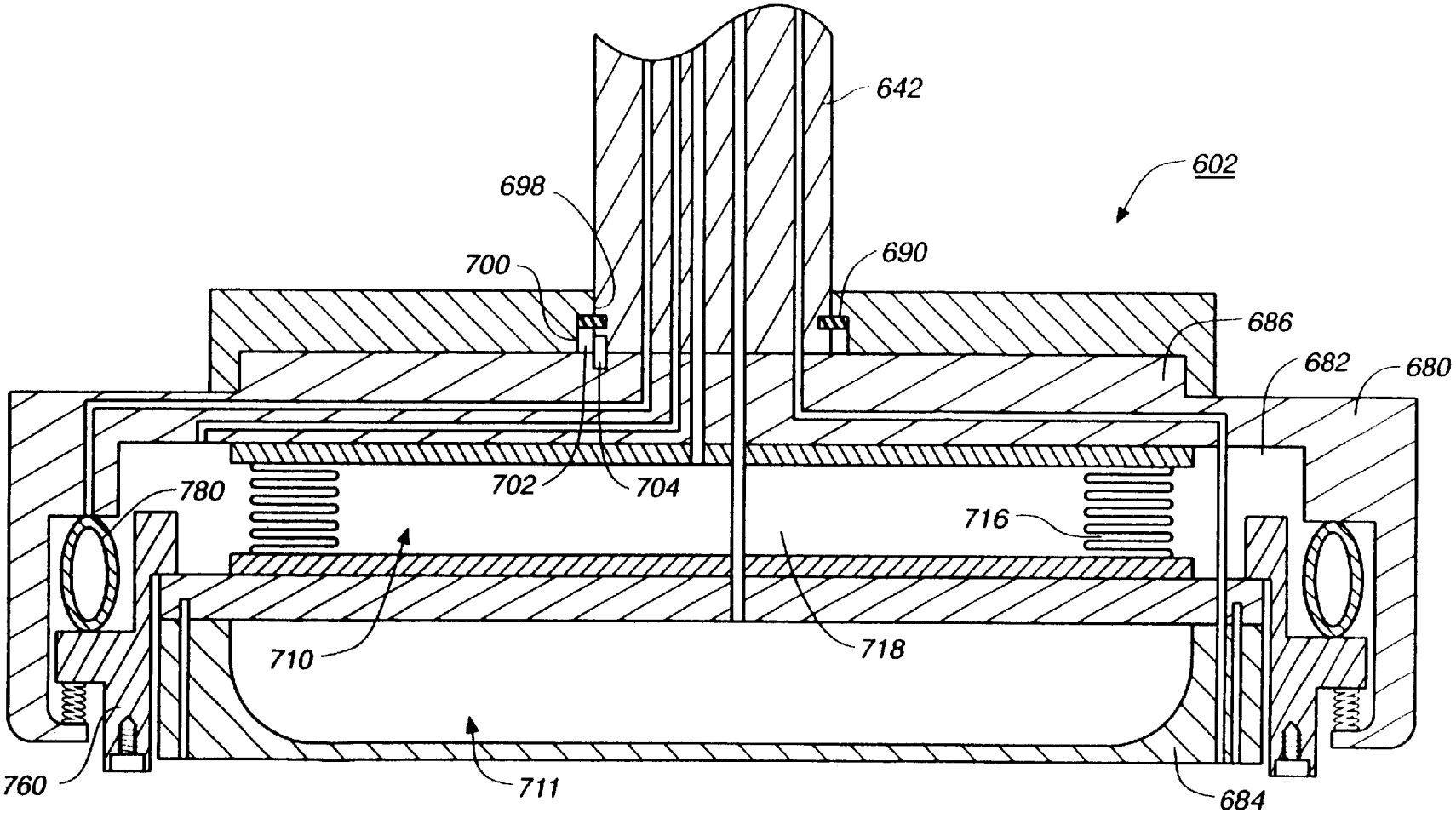
FIG. 7 is a sectional view of the polishing head of FIG. 6, showing the retainer extended from the polishing head.

Referring still to FIG. 6, the head 602 also preferably includes a retainer ring 760, which, during polishing, extends into contact with the polishing surface and which is otherwise retractable inwardly and upwardly of the head 602. In the preferred embodiment of the head 602, the retainer ring 760 is an annular member having a planar base 764 on which a replaceable contact ring 766 is fixed, and it further includes an outwardly extending annular ledge portion 765. The bowl member 680 includes an inwardly extending annular ledge 768, which extends below the surface of the outwardly extending ledge portion 765 of the retainer ring 760. To secure the retainer ring 760 within the recess 682 of the bowl member 680, a plurality of compressed springs 770 extend between the inwardly extending ledge 768 of the bowl member 680 and the underside of the outwardly extending ledge 765 of the retainer ring 760. These springs continuously bias the retainer ring 760 inwardly and upwardly of the bowl member 680. To project the retainer ring 760 from the bowl member 680 and to vary and control the extent of projection, a toroidal bladder 780, which is inflated through an unillustrated tube stem, extends between the upper surface of the outwardly extending ledge 764 of the retainer ring 760 and the underside of a middle ledge 712 of the bowl member 680 about the entire circumference of the retainer ring 760. When the bladder 780 is evacuated, as shown in FIG. 6, the retainer ring 760 is retracted inwardly and upwardly of the head 602. When the bladder 780 is positively pressurized, as shown in FIG. 7, the bottom of the retainer ring 760 extends downwardly from the wafer head 602. The bladder 780 can be replaced by a pair of annular bellows joined on respective ends to the middle ledge 712 of the bowl member 680 and the ledge 765 of the retainer ring 760.

Wafer Head Utilities Connections

The wafer head 602, as shown in FIG. 6, preferably includes a plurality of bores extending vertically through the head drive shaft 642 to connect utility sources to the wafer head components. To vary the pressure in the bellows cavity 721, a bore 782 in the drive shaft 642 connects to a passage 784 through the boss 686 and the upper bellows cavity plate 722 into the bellows cavity 721. The bore 782 through the drive shaft 642 is selectively pressurized through the rotary union 644 by a variable pressure source (not shown) which provides pressurized air to bias the carrier plate 684 toward the polishing surface, and also provides vacuum to retract the carrier plate 684 into the bowl member 684. A bow chamber passage 785 is connected from a bow chamber bore 752 in the drive shaft 642 and into the bow chamber 730. The bow chamber bore 752 is connected to a variable pressure source 802, which selectively supplies pressurized air or vacuum to the bow chamber 730 to increase or decrease the asymmetry of loading the substrate center relative to loading the substrate edge. A bore 758 in the drive shaft 624 is connected to a ring port 774 that is connected to the stem of the toroidal bladder 780. When positive pressure is applied to thereby expand the bladder 780, it moves the retainer ring 760 in the direction of the polishing surface to bias the carrier plate 684 toward the polishing surface and thereby frictionally engage the wafer with the polishing pad. When negative pressure is applied to contract the bladder 780, it retracts the retainer ring 760 and thereby retracts the retainer ring 760 inwardly of the head. Another bore 756 extending vertically through the drive shaft 642 communicates with a flush bore 778 extending through the bowl member 680 to a plurality of flush ports 780 (only one is shown). The bore 756 in the drive shaft 642 in turn communicates with a source of deionized water through the rotary union. Deionized water supplied through the flush bore 778 enables the head 602 to be flushed rinsed with the deionized water. Finally, a vertical bore 788 in the drive shaft 642 communicates with a release bore 786 extending from the terminus of the shaft 642 into a plurality of release ports 787 (only one shown) adjacent to the recess 732 for the wafer. The vertical bore 788 communicates with a variable pressure/water source 810. To secure the substrate to the membrane 734 of the head 602 during movement of the head between processing stations, the release bore 786 is evacuated. To eject the substrate from the head 602, pressurized water is flowed through the release bore 786.

The Loading/Unloading Station

Figure 8A:
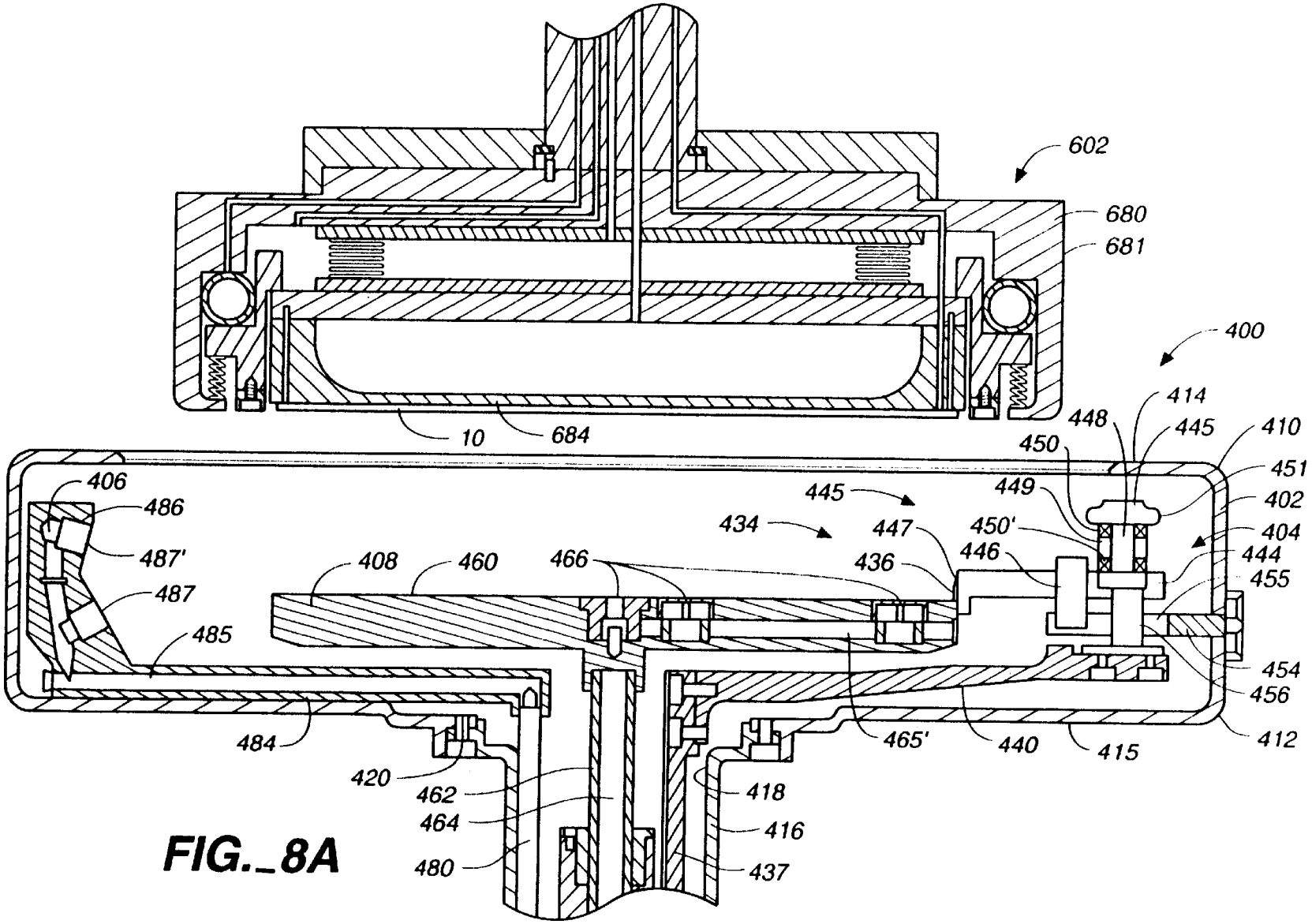
FIGS. 8A and 8B are parts of a sectional view of the load/unload apparatus of the polishing apparatus of FIG. 1.
Figure 8B:
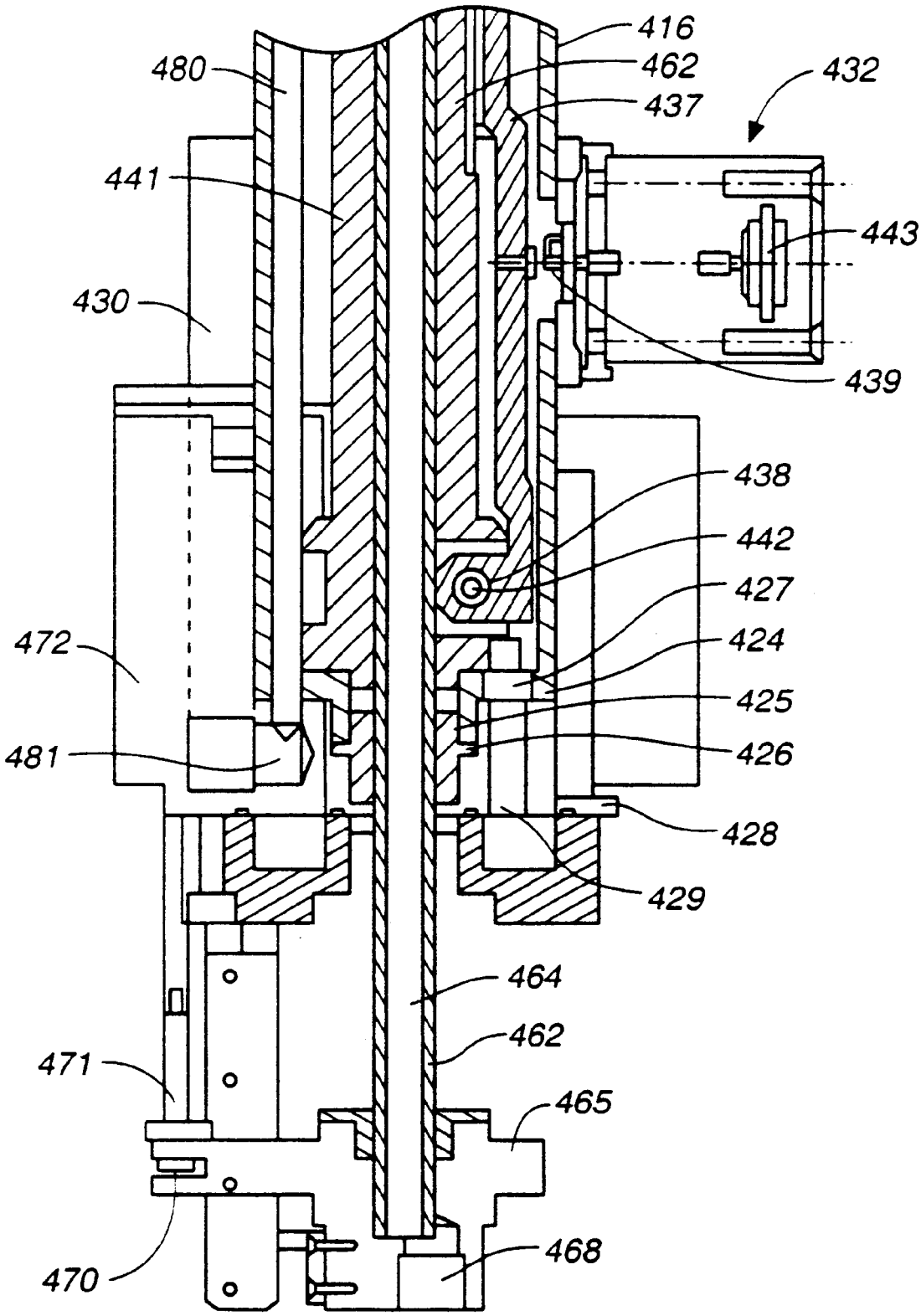
Figure 9:
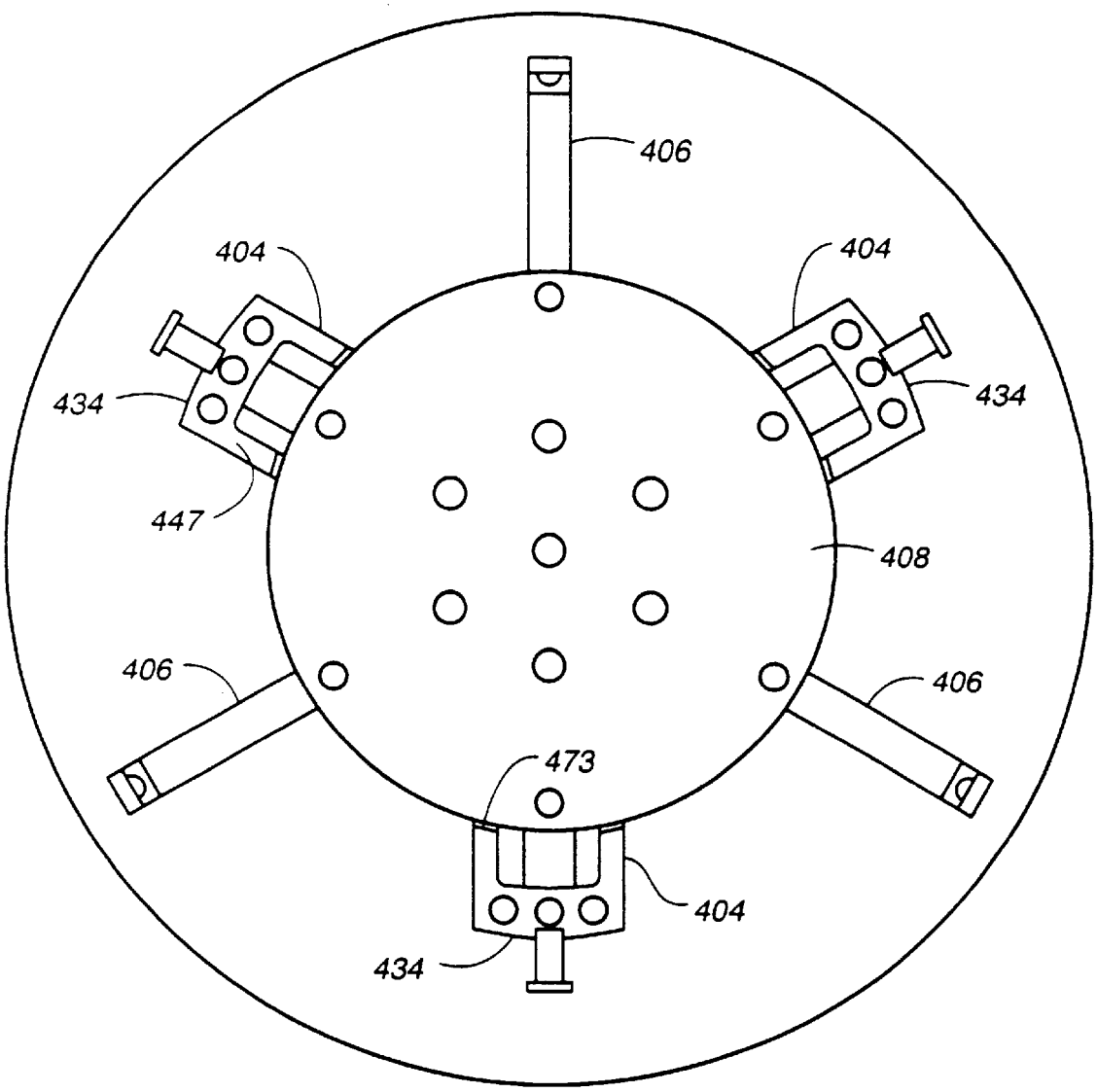
FIG. 9 is a top view of the load/unload apparatus of FIGS. 8A and 8B.

The details of the load/unload station 400 are shown in the split cross-sectional view of FIGS. 8A and 8B and the plan view of FIG. 9. In the preferred implementation of the invention, the load/unload station 400 manipulates substrates onto and off of the substrate carrier plate 684 of the wafer heads 602, 602', and also rinses the surfaces of the substrate and of the head 602, 602'. To provide these features. the load/unload station 400 preferably includes a generally circumferential outer basin shroud 402 located above, and selectively positionable with respect to, the upper surface of the table top 126 terminate. A plurality of gripping finger assemblies 404 terminate within the shroud 402 and are controllably arcuately positionable within the shroud 402. A spray apparatus 406 located in the shroud 402 rinses the substrate and the carrier plate 684. A substrate pedestal 408 is vertically movable within the shroud. In use, one of the wafer heads 602, 602' is located over the open end of the shroud 402, and the shroud 402 is moved upwardly over the outer surface of the head 602, i.e., over the outer surface of the bowl member 680 of the head 602. As the shroud 402 is moved upwardly, the head 602 is received within the plurality of finger assemblies 404, at which time the substrate 10 and head 602 are sprayed with water emitted from the spray apparatus 406. The substrate is then ejected from the head 602, and is supported on the substrate pedestal 408 and is centered thereon by the finger assemblies 404, as will be described further herein. The shroud 402 then retracts to create clearance between the load/unload station 400 and the head 602 so that the spray apparatus 406 can rinse the back of the substrate and the empty wafer head 602. The pedestal 408 then moves upwardly and positions the substrate above the top of the shroud 402 where a robot blade 152 (shown in FIGS. 1 and 14) can access the substrate with a vacuum chuck. The robot blade 152 then removes the substrate from the pedestal 408, and places a new substrate thereon. The pedestal 408 moves up to receive the substrate, and then retracts into the shroud to allow the blade to retract and the head 602 to be positioned over the load/unload station 400. The pedestal 408 then moves upwardly to press the substrate against the substrate receiving surface of the head 602.

The Shroud

The shroud 402 is shaped like a cup with an overhanging inward lip and provides a housing within which the remainder of the load/unload station components are housed. It also provides a shield to minimize spraying or splashing of water or rinsed slurry and other polishing products from the load/unload station and onto other apparatus components. The shroud 402 generally includes an upper, bowl shaped portion 410, having an outer circumferential wall 412, an inwardly extending upper lip 414 and a generally circular base 415, and a hollow basin stem 416 extending downwardly from an aperture 418 in the center of the base 414.

In the preferred embodiment of the invention, the upper end of the basin stem 416 includes an outwardly extending flange 420, on which the base 415 rests. A lower end 422 of the basin stem 416 includes an inwardly extending flange 424 terminating in an aperture 425 through which a sleeve 426 vertically extends, and a plurality (only one shown) of drain apertures 427 extending through the flange 424. To retain the sleeve 426 on the stem 416, a cover nut 428 is threaded over a downwardly extending extension of the stem 416 adjacent the aperture 425. This nut 428 includes a plurality of drain holes 429 (only one shown) therethrough, which register with the drain apertures in the flange 424.

To position the shroud 402 relative to the table top 126, one end of a pneumatic cylinder 430 is connected to the outer surface of the basin stem 416 adjacent to the lower end thereof, and the second end of the cylinder 430 is connected to the table top 126. The cylinder 430 moves the shroud 402 upwardly and downwardly with respect to the table top 126 and carries the pedestal 408 with it.

The Finger Assemblies

Referring still to FIGS. 8A, 8B, and 9 but especially to FIG. 8A, the load/unload apparatus 400 includes a plurality of, preferably three, finger assemblies 404. Each finger assembly 404 includes a biasing portion 432 on the middle portion of the basin stem 416 and a head gripping portion 434 in the shroud 402 within which a substrate receiving portion 436 is located. The biasing portion 432 provides the alignment and positioning of the head gripping portion 434 to align the head 602 with bumpers 445 and to align the substrate with the substrate aligning portion 436 at the distal ends of fingers 447.

Referring to FIG. 8B, there are shown the details of one of the biasing portions 432. Each of the three biasing portions are preferably identical. The biasing portion 432 includes a pivot arm 437, having a lower pivot connection 438 fixed to the bottom of the basin stem 416, an intermediate bias connection 439, and an outwardly extending support arm 440 (FIG. 8A) on which the head gripping portion 434 is received. The biasing portion 432 is configured to swing about the pivot connection 438 to enable movement of the gripping portion 434 to align the head 602 or substrate 10.

In the preferred embodiment, a tubular sleeve 441 is received within the stem 416, and the pivot connection 438 is connected to a shaft 442 on the lower end of the tubular sleeve 441. The pivot arm 437 extends upwardly from the pivot connection 438 in the annular space between the basin stem 416 and the tubular sleeve 441. The upper end of the vertically extending pivot arm 437 terminates above the upper surface of the base 415 of the shroud 402, and the support arm 440 extends radially outwardly therefrom. To provide the arcuate positioning of the pivot arm about the shaft 439, a biasing member 443, preferably an actuator, such as a double acting pneumatic cylinder with a center rest position, has an output shaft fixed connected to the swing arm approximately midway between the pivot connection 438 and the upper terminus of the pivot arm 437. The actuator 443 allows the pivot arm 437 to be swung in a small arc about the pivot connection 438, but it tends to move the pivot arm 437 to preselected positions to provide preselected locating of the pivot arm 437, and thus of the radially extending support arm 440 and the finger assemblies 404 attached thereto. These positions are the same for all three of the finger assemblies 434 so that each of the finger assemblies 434 is spaced at a nearly identical distance from the center of the substrate pedestal 408 for concurrent operation of the three actuators 432.

Referring to the left side of FIG. 8A, each finger assembly 434 includes a finger base 444, on which are mounted two roller members 445 arranged generally circumferentially within the shroud 402, an alignment pin 446 to restrict the rotation of the finger base 446, and a pivot pin 456 about which the finger base 444 rotates. Additionally, the radially innermost surface of the finger base 444 has a face chamfered on its upper side, which provides a tapered substrate receiving face for badly misaligned wafers, as will be discussed further herein. Each roller member 445 includes a central pin 448 which extends upwardly from the base 444, and an outer cylindrical body 449 supported over the pin on a pair of bearings 450, 450'. The body 449 of the bumper 445 also includes a circumferential raised portion 451.

To secure the finger base 444 to the support arm 440, the pivot pin 456 extends upwardly from the support arm 440, and is received within a pair of unillustrated bearings in a bore in the finger base 444. Thereby, the finger base 444 may swing in a slight arc about the pivot pin 456. This allows the body portion to swing through a slight arc to accommodate slight misalignment between the wafer head 602 and the load/unload apparatus 400 when the head 602 with attached substrate is first received in the shroud 402.

When the wafer head 602 is first received in the shroud 402, it may be rotating. Therefore, the engagement of this rotating member with the circumferential raised portion 451 of the rotatable bumper 445 will tend to cause the entire finger base 444 to swing arcuately about the pivot pin 453. To prevent this, an alignment fork 454, having an alignment slot between two tines, extends inwardly from the circumferential face of the shroud 402, and a restraint pin 446 extends downwardly from the finger base 444 and into the alignment slot. The slot allows radial movement of the finger body 444 in the slot, but restrains against substantial circumferential motion of the claw body 444.

Referring again to FIGS. 8A and 9, each finger assembly 434 includes two inner upwardly and outwardly tapered faces which are located just outside of a circular locus at the diameter of a substrate. The tapered faces of the three finger assemblies 434 therefore provide six substrate receiving surfaces, on which a misaligned substrate may be deposited and readjusted during the loading and unloading process.

The Substrate Support

Referring now to the central portion of FIG. 8A, the details of construction of the substrate pedestal 408 are shown. Preferably, the substrate pedestal 408 includes an upper, planar support face 460, which is positioned with respect to the shroud 402 by three drive shafts 471 (FIG. 8B) connected to the bottom of a pedestal stem 462 through the three-legged spider 465 at the underside of the pedestal 408. The pedestal stem 462 extends downwardly from the underside of the pedestal 408 and through the sleeve 441 in the basin stem 416 and then outwardly through the base of the basin stem 416.

The pedestal stem 462 preferably includes a bore 464 extending the axial length thereof, which intersects a plurality (only one shown) of cross bores 465' within the support member 460. Spray heads 466 extend at one central location from the upper terminus of the bore 464 and at numerous offset locations from the cross bores 465' and through the surface of the support face 460 to spray wash liquid in a generally upward direction. At the lower end of the pedestal stem 462. the stem bore 464 terminates at the lift spider 465, which includes a threaded aperture 468 therein which communicates with the stem bore 464 for the pedestal spray heads 466. A water line is received in the aperture 468, to provide water to the stem bore 464 and spray heads 466 at the top surface of the pedestal 408.

The lift spider 465 also includes a lift claw 470 extending therefrom, which is connected to the rod 471 of a hydraulic piston 472 attached to a side of the basin stem 416 of the shroud 402. When the piston 472 moves the rod 471, it vertically moves the pedestal stem 462 relative to the basin stem 416, and thus moves the substrate pedestal 408 upwardly or downwardly with respect to the shroud 402.

As the pedestal 408 is moved upwardly and downwardly, it may pass through the region of the fingers 447 of the finger assemblies 434 on which the substrate may be positioned because of misalignment. To allow passage of the pedestal 408 past these fingers 447, six recesses 473 (shown in FIG. 9) may extend into the edge of the pedestal 460 at the locations of each of the fingers 447.

The Spray Apparatus

Referring now to the left side of FIG. 8A, the details of one spray apparatus 406 are shown. In the preferred embodiment, three spray apparatus are used, spaced 120° apart about the perimeter of the pedestal 408. Each spray apparatus 406 includes a tubular feed member 480 which extends upwardly from a feed port 481 located with, and adjacent to the base of the basin stem 416 to a position adjacent to, and above, the bottom of the shroud 402. It further includes a spray arm 484 extending from the upper terminus of the feed member 480 and radially outwardly to a position adjacent the inner surface of the circumferential wall of the shroud 402. An upwardly extending spray housing 486 is formed at the outermost position of the spray arm 484. The spray arm 486 includes a feed passage 485 extending therethrough to communicate water, or other fluids, from the tubular feed member 480 to a pair of spray nozzles 487, 487' which are located in the spray housing 486. One of the nozzles 487 is positioned to direct a flow of water or other fluid upwardly away from the pedestal 408 in the illustrated position, and the second of the nozzles 487' is positioned to direct water, or other liquid, downwardly in the direction toward the pedestal 408.

Operation of the Load/Unload Apparatus

The operation of the load/unload apparatus is shown sequentially in FIGS. 8A, 9, 10 and 11. In FIG. 8A, the wafer head 602, with a substrate 10 held on its bottom side, is located over the load/unload station 400. When the wafer head 602, with a just polished substrate 10, is positioned over the load/unload apparatus 400, the shroud 402 and the pedestal 408 are in the fully retracted position.

Figure 10:
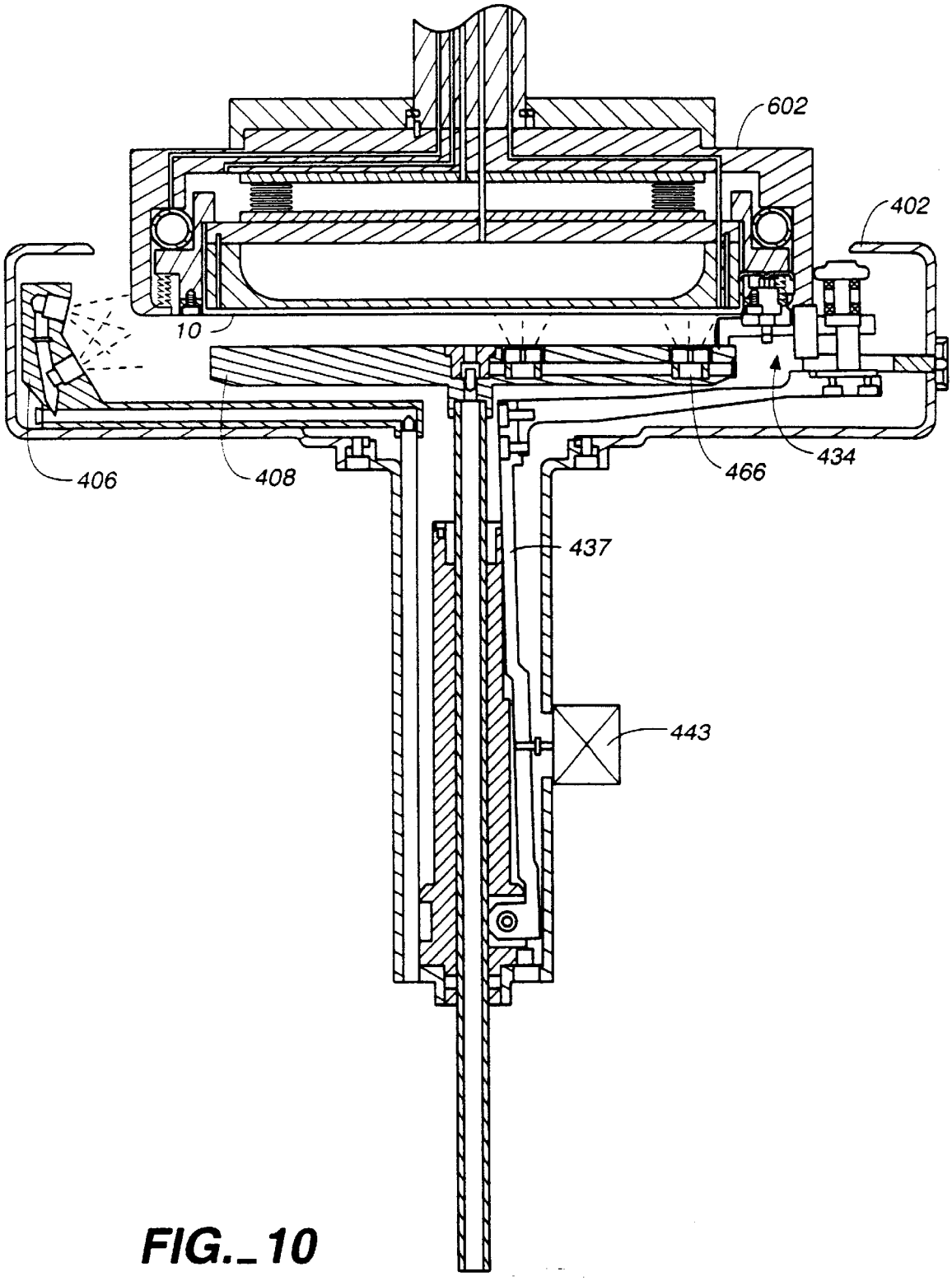
FIGS. 10 through 16 are simplified cross-sectional view of the load/unload apparatus of FIGS. 8A and 8B showing the loading and unloading sequences.

Once the wafer head 602 is positioned in a centered position over the load/unload station 400, the shroud 402 of the load/unload station 400 is moved upwardly to the position shown in FIG. 10. As the shroud 402 moves upwardly, the outer cylindrical face 681 of the bowl member 680 of the head 602 is received within the area surrounded by the rotatable bumpers 445 and is realigned by them as required. The pneumatic actuators 443 are activated to push inwardly the pivot arms 437 and hence the finger assemblies 434. The bumpers 445 engage the sides of a misaligned head 602, and together they realign it, after which finger assemblies 434 are retracted outwardly and the carousel is locked in place. If the head 602 is rotating, the bumpers 445 will also rotate. As the entire unload assembly 400 moves up over the wafer head 602, and the finger assemblies 434 engage the wafer head, one or more of the pivot arms 437 may be pushed outwardly, and the double acting pistons will restore the pivot arms 437, and thus the rotatable bumpers 445, at the rest position which corresponds to alignment of the substrate receiving portion of the head with the support pedestal 408.

Once the wafer head 602 is properly positioned over the pedestal 408, the spray nozzles 487, 487' in the spray assemblies 406 and at leasts the offset ones of the spray heads 466 in the substrate pedestal 408 are supplied with clean, deionized water to spray the just polished surface of the substrate 10 held in the wafer head 602 and the sides and other exposed surface of the wafer head 602 and the pedestal 408. Additionally, water may be flowed through the flush passage 780 (FIG. 6) on the backside of the wafer head 602 to clean the backside of the carrier plate 684, the exterior of the bellows 716, and the exposed surfaces of the retainer ring assembly 760.

Figure 11:
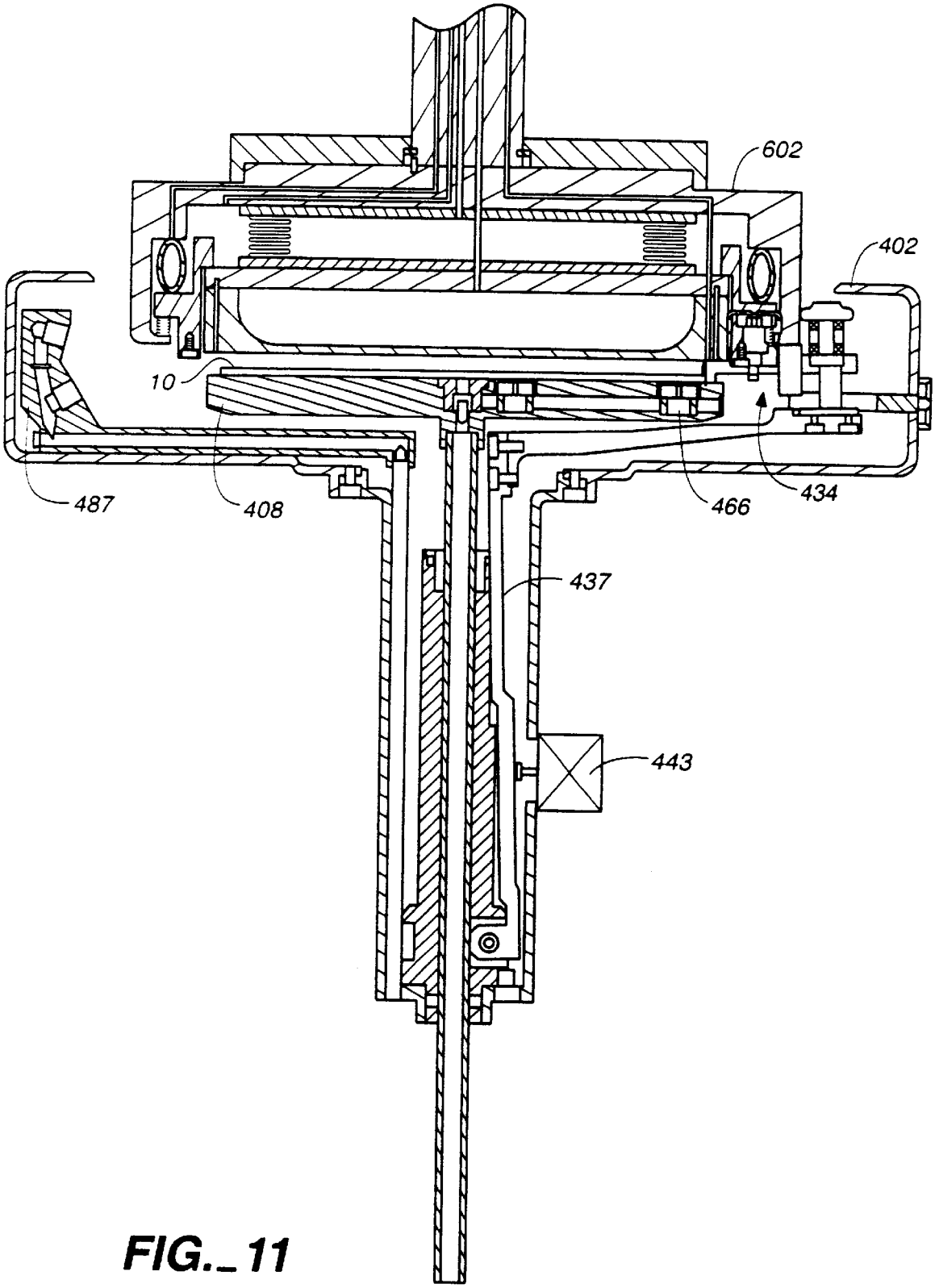

After the surfaces of the pedestal 408 are flushed with water, the pedestal stem 462 and attached pedestal 408 are raised and the bellows cavity of the wafer head 602 is pressurized, to position the edge of a substrate 10 held on the substrate receiving surface of the carrier plate 684 nearly on the pedestal 408. Then, as shown in FIG. 11, the eject passages of the wafer head 602 are supplied with water, under slight pressure, to eject the substrate 10 from the wafer head 602 onto the pedestal 408. If the wafer head 602 has remained badly misaligned, the wafer 10 falls onto the chamfered upper faces of the fingers 447 of the finger assemblies 434 and falls off them to be better centered. The bladder cavity is then evacuated, to retract the carrier plate 684 into the wafer head 602.

Figure 12:
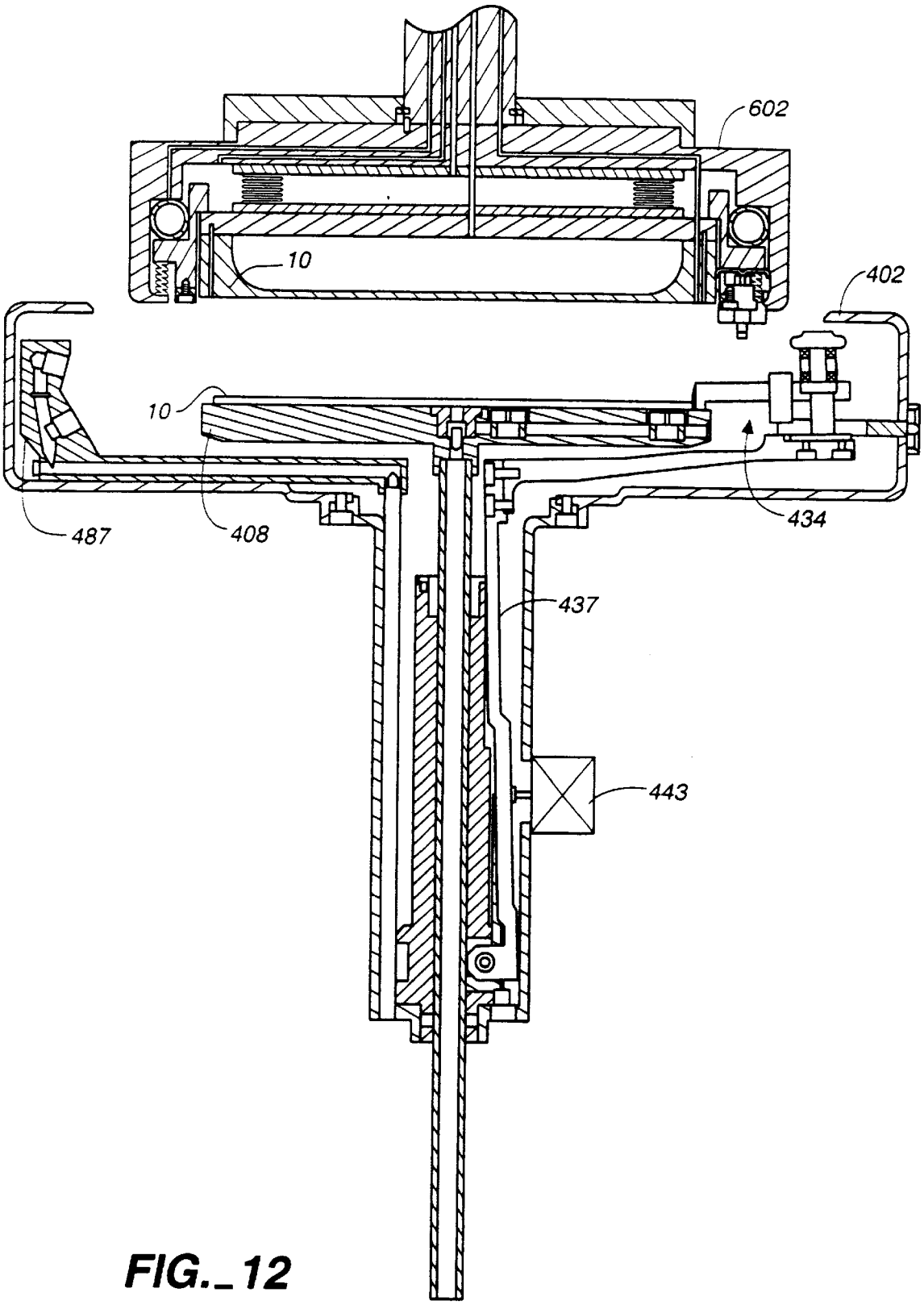
Figure 13:
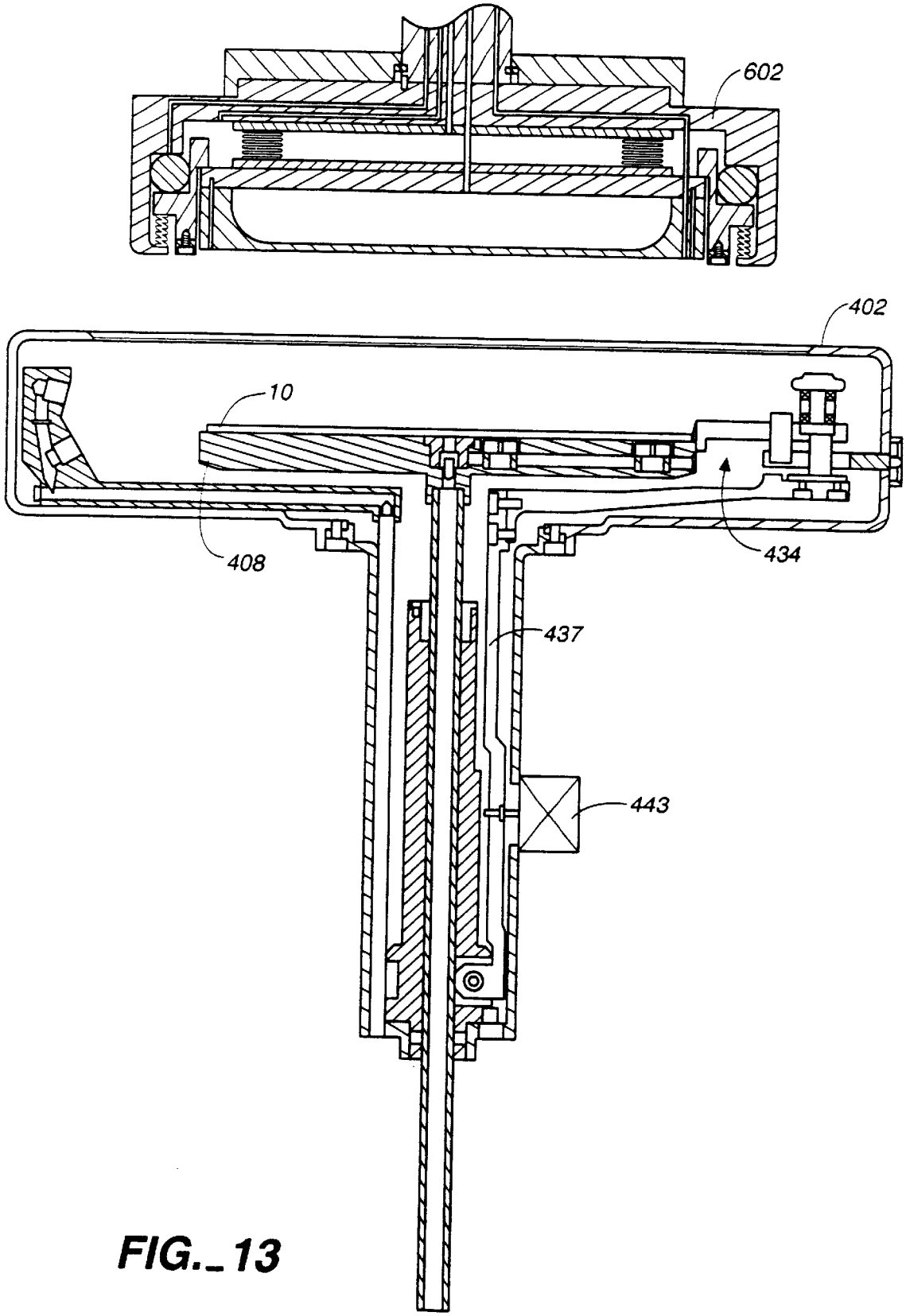
Figure 14:
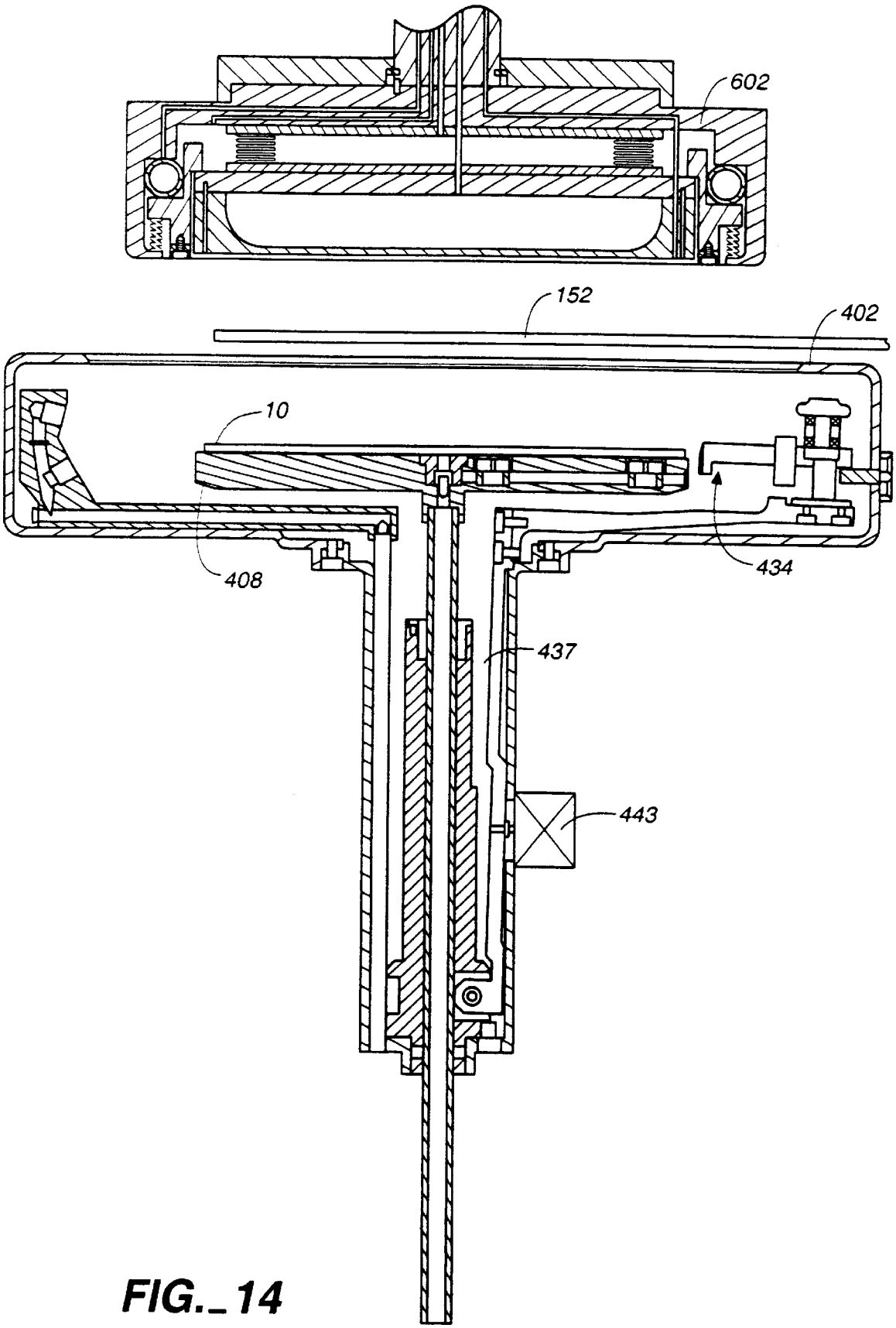

The basin 402 and attached pedestal 408 are then retracted downwardly away from the wafer head 602, as shown in FIG. 12. Then, as shown in FIG. 13, the actuators 443 push inwardly the pivot arms 437 and attached finger assemblies 434 so as to align the wafer 10 on the pedestal. The finger assemblies 434 are then withdrawn outwardly, as shown in FIG. 14.

Figure 15:
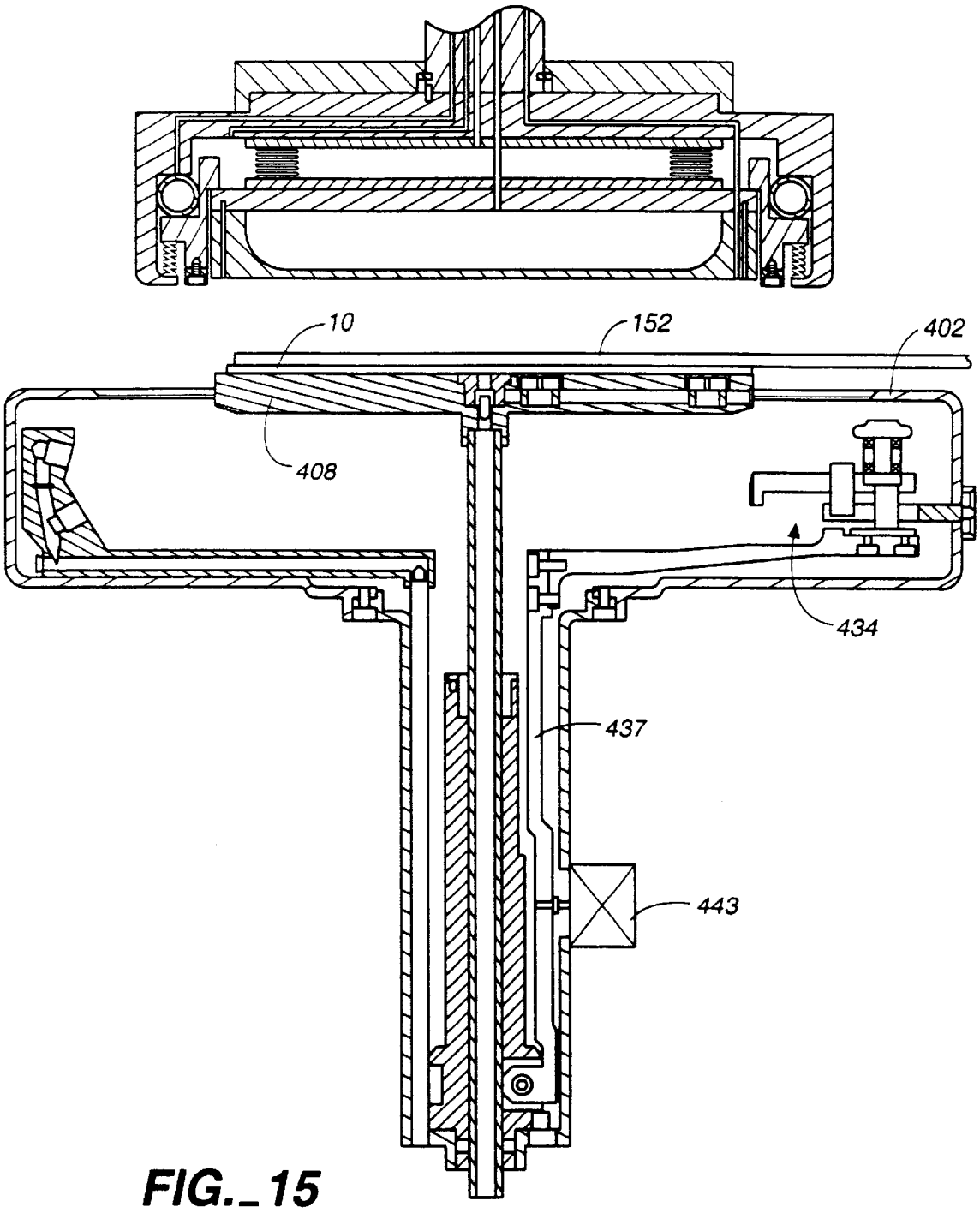

To remove the substrate from the load/unload station 400, a robot blade 152 is inserted between the bottom of the wafer head 602 and the top of the shroud 402. The pedestal 408 is then raised above the top of the shroud 402, as shown in FIG. 15, to place the wafer 10 directly below and substantially in contact with the robot blade 152. The robot blade 152 includes a plurality of vacuum apertures on its lower face (not shown), which enable gripping of the substrate to the blade 152. Once the substrate 10 contacts or nearly contacts the robot blade 152, the vacuum apertures affix the substrate to the blade 152, and the blade 152 retract from the load/unload station 400 and deposits the substrate in a suitable carrier (not shown).

To position a new substrate 10 on the wafer head 602, the robot retrieves a substrate, and positions it over the load/unload station 400. Before the robot 152 is positioned over the load/unload station, the pedestal 408 is retracted slightly inwardly of load/unload station 400. Once the blade 152 is repositioned over the load/unload station 400, the pedestal 408 is moved upwardly against the substrate (as in FIG. 15).

Once the new substrate 10 is received on the pedestal 408, the robot blade 152 horizontally retracts from the region above the pedestal 408 as the pedestal downwardly retracts through the area between the retracted finger assemblies 434 to a position 408' shown by the dashed lines in FIG. 16 at which the tips of the fingers of the finger assemblies 434 can engage the substrate 10. The actuators 443 then move the pivot arms 437 and attached finger assemblies 434 in an inward direction to align the substrate 10 in a centered position on top of the pedestal 408 with respect to the pedestal support member 408. The pedestal 408 is then raised to a position above the top of the shroud 402. Then, the shroud 402 and attached pedestal 408 are moved upwardly, as shown in the solid lines of FIG. 16. The entire load/unload apparatus 400 then moves upwardly, nearly to the position shown in FIG. 16, so that the wafer 10 nearly abuts the bottom of the wafer head 602. The bellows cavity of the wafer head 602 is then pressurized, to extend the plate 684 into contact with the wafer 10. A vacuum is then pulled through the vacuum passages in the head 602 to secure the substrate to the plate 684, and the bellows cavity is evacuated to lift the plate 684, and the substrate, inwardly into the wafer head, as shown in FIG. 8A, to enable the wafer head 602 to be moved to the polishing station 200 to begin substrate polishing.

The Preferred Polishing Sequence

Figure 17:
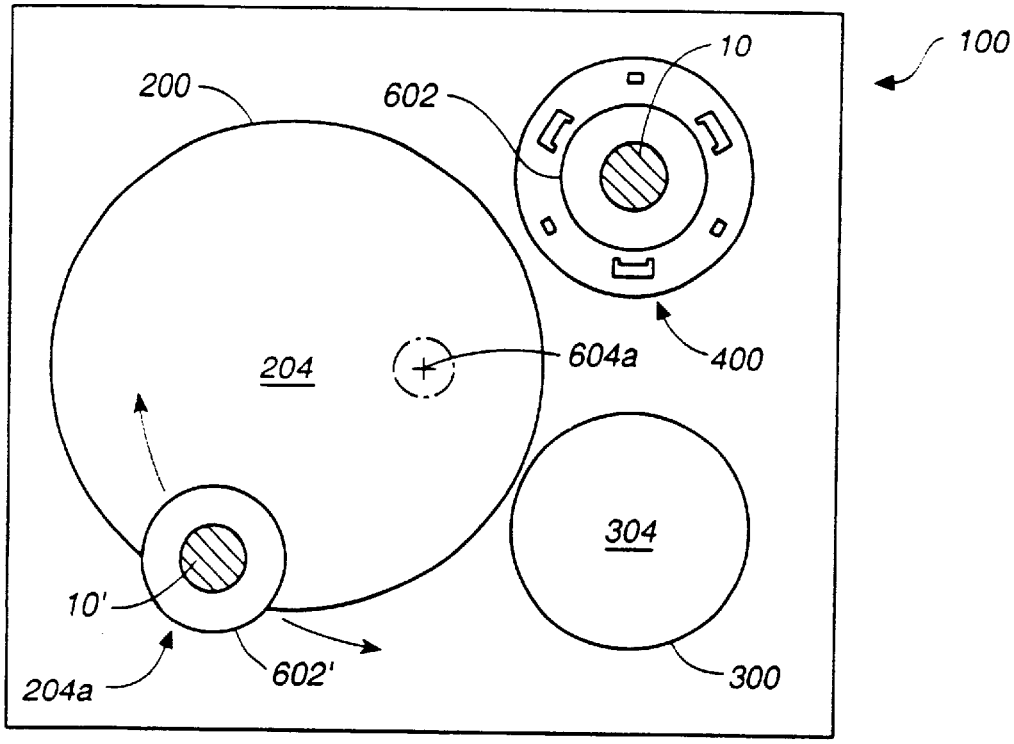
FIGS. 17, 18, 19, and 20 are plan views showing the sequence of processing steps using the polishing apparatus of FIG. 1.

Referring now to FIGS. 17 to 20, the passage of substrates through the polishing apparatus is shown in sequence. Referring initially to FIG. 17, the polishing apparatus 100 is shown as a first substrate 10 is being loaded into the first wafer head 602 located over the loading/unloading station 400. During the loading of the first wafer head 602, the second wafer head 602' and a second wafer 10' held therein are located over the first polishing station 200.

The loading and unloading of substrates from the wafer head 602 is contemplated to be a relatively fast operation such that the time needed to load and unload is significantly less than the time which the substrate 10 must be positioned against and preferably moved over the polishing surface of the polishing pad 204 of the first polishing station 200 during this one phase of the polishing of the exposed surface of the first wafer 10. Once the first substrate 10 has been loaded into the first wafer head 602, the carousel 604 not illustrated in FIG. 17 circumferentially oscillates in a reciprocal about its center 604*a* to cause the first wafer head 602 and its wafer 10 to reciprocally sweep through a predetermined arc to polish the second wafer 10' held in the second wafer head 602' over a first position 204*a* of the first polishing pad 204. Although its motion is not illustrated, the second wafer head 602' also circumferentially oscillates over the loading/unloading station 400; however, its lower face has been retracted vertically upwards from the loading/unloading station 400, and it performs no processing during the sweeping operation. The carousel 604 is reciprocally rotated about the overhead platform 104 by rotating the sleeve 606 with the carousel drive motor 616 through an arc of approximately 10 to 20 degrees. During the loading of the substrate onto the head 602 (or 602'), the carousel 604 should remain stationary absent any specially designed load/unload station 400 which could move with the oscillating carousel 604. However, once the substrate 10 is loaded into the head 602 (or 602'), the sweeping action of the carousel 604 may continue.

Figure 18:
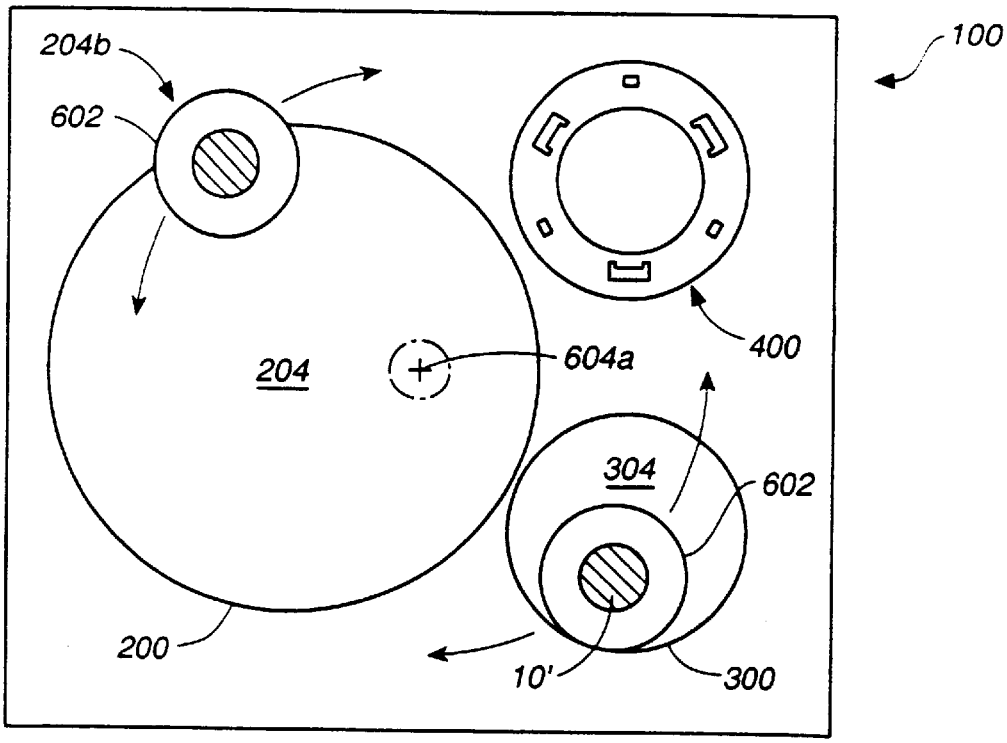

Once the polishing endpoint is reached for the second wafer 10' at the first polishing position 204*a* at the first polishing pad 204 (note that this endpoint refers only to the stage of polishing in the preferred embodiment and not to the total polishing), the carrier plate 684 in the second wafer head 602' is retracted, and as illustrated in the plan view of FIG. 18, the carousel 604 rotates about its center 604*a*, in a counterclockwise direction from the perspective of FIG. 17, to position the second wafer head 602' over the second polishing station 300 and simultaneously to position the first wafer head 602 over a second polishing position 204*b* of the first polishing station 200. Once both heads 602, 602' have been properly positioned, the vacuum conditions in the two bladder chambers 718 of the two heads 602, 602' are vented, and the chambers 714 are pressurized to urge the respective carrier plates 684, and thus the wafers 10, 10' thereon, into contact with the polishing surfaces of the pads 204, 304 of the two polishing stations 200, 300. Again, during polishing, the carousel 604 is swept through an arc of typically approximately 10 to 20 degrees, dependent on the diameters of the two polishing pads 204, 304 and the proximity of the second polishing position 204*b* to the edge of the first polishing pad 204. Note that FIG. 18 shows the first wafer head 602 overhanging the edge of first polishing pad 204 while its attached wafer 10 remains at all times on the pad 204. It is possible to cantilever a wafer over the edge of the polishing pad, but such a cantilever position is not recommended. The large sweep of the wafers 10, 10' over the two pads 204, 304 ensures that the wafer heads 602, 602' pass the wafers 10, 10' over a substantial radius of the polishing surfaces, and thereby use almost all of the polishing surface for polishing, and thereby tend to average out pad non-uniformities.

As described, the two wafers 10, 10' are simultaneously polished on the two polishing pads 204, 304. The wafer polishing at the second polishing station 300 is preferably performed with deionized water rather than slurry, and is intended to clean the substrate of any slurry embedded into the surface of the substrate during polishing on the first polishing station 200, and to provide a finer surface finish on the polished or planarized surface of the substrate. This process is sometimes referred to as buffing. To provide the finer surface finish, the second polishing pad 304 has a finer nap, which will impart a smoother finish on the substrate.

Once the polishing of the substrate being polished on the second polishing station 300 has reached a polishing endpoint, the substrate can be removed from the apparatus so that the second head 602' may be used to polish an additional substrate. However, typically in the joint and simultaneous polishing at the two polishing stations 200, 300, the polishing time is controlled by the initial rough polish at the first polishing station 200. At the cessation of polishing at the second polishing station 300, the bellows cavity 714 of the head 602' is evacuated, which lifts the carrier plate 684 and the wafer 10' attached thereto off the polishing surface 304 of the second polishing station 300. This lifting is accomplished while the carousel continues to sweep the wafer heads 602, 602' through the arc.

Figure 19:
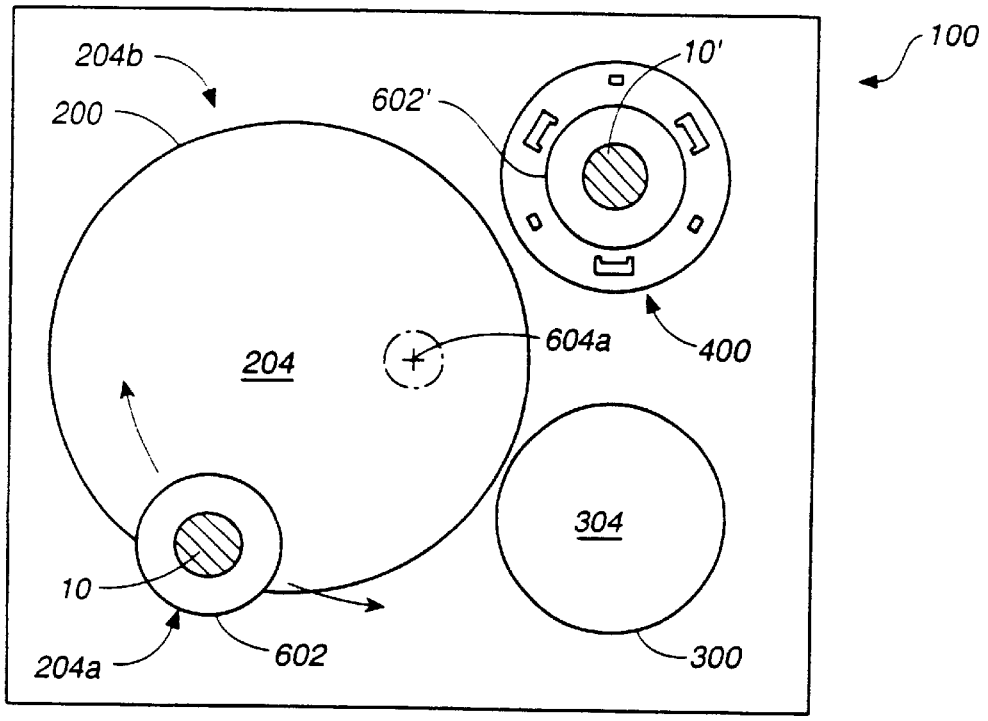

When the first stage of rough polishing of the first wafer 10 at the second polishing position 204*b* on the first polishing pad 204 has reached its endpoint, the polishing is stopped by the carrier plate 684 being retracted into the second head 602' so as to raise the first wafer 10 above the polishing pad 204. Then, the carousel 604 again rotates, as illustrated in FIG. 19, to move the second wafer head 602' and attached wafer 10' from a position over the second polishing station 300 to a position above the loading/unloading station 400. This carousel motion simultaneously moves the first wafer head 602 from the second polishing position 204*b* to the first polishing position 204*a* of the first polishing pad 204. Again, this motion is provided by rotating the carousel in a counterclockwise direction from the perspective of FIGS. 18, 19 and 20.

When the second wafer head 602' is located over the loading/unloading station 400, the polished wafer therein may be rinsed and removed, and a new wafer placed in the second wafer head 602', as described in the proceeding description of the loading/unloading station 400. Once a new, third wafer 10" has been placed into the second wafer head 602', the carousel 604 reinitiates its circumferential oscillation so as to cause the first wafer head 602 and attached wafer 10 to be reciprocally swept across the first polishing position of the first polishing pad 204.

Figure 20:
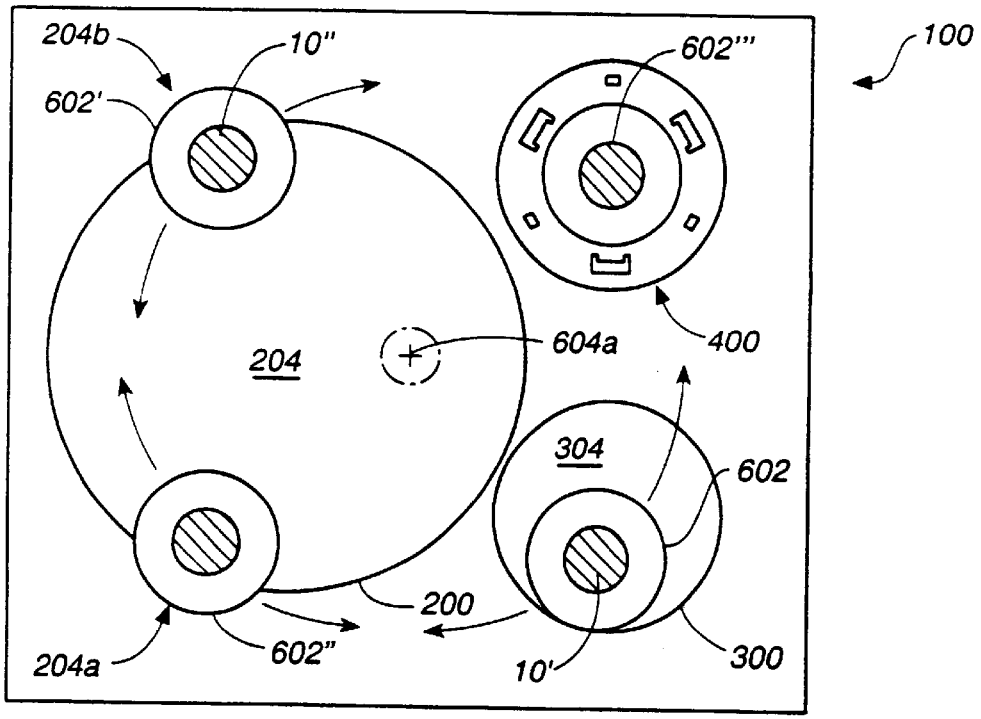

Once the polishing endpoint for rough polishing has been achieved for the first wafer 10 located in the first wafer head 602 at the first polishing position 204*a* of the first polishing station 200, as illustrated in FIG. 20, the carousel 604 is rotated to place the first wafer head 602 and attached first wafer 10 at the second polishing station 300 and also to place the second wafer head 602' with the attached third wafer 10 at the second polishing position 204*b* of the first polishing pad 204. Preferably, the positioning is provided by moving the carousel 604 in a clockwise direction by 270°. This backward rotation allows the carousel to rotate no more than 360° in its entire operation. Electrical and fluid connections to the carousel 604 can be accommodated in this limited rotation by flexible lines rather than substantially more complex rotary unions and slip rings that would be required if the carousel 604 were also rotated in the same direction between successive positions. This 270° motion swings the first wafer head 602 over the loading/unloading station 400, to position it over the second polishing station 300 and to place the second wafaer head 602' over the second polishing position 204*b* of the first polishing pad 204. In this position, the carousel performs its circumferential oscillation so as to rough polish the third wafer 10" on the first polishing pad 204 and to fine polish the first wafer 10 on the second polishing pad 304. This completes the polishing of the first wafer 10, whereafter it is unloaded at the loading/unloading station 400.

The process continues in the same fashion whereby one rough polish of a wafer is performed simultaneously with a fine polish of another wafer.

The process could obviously be improved by including at least two more polishing heads so that two wafers are being rough polished while a third wafer is being fine polished, a fourth head being positioned over the loading/unloading station 400 while the three-fold polishing is being performed.

The Conditioning Apparatus

Figure 21:
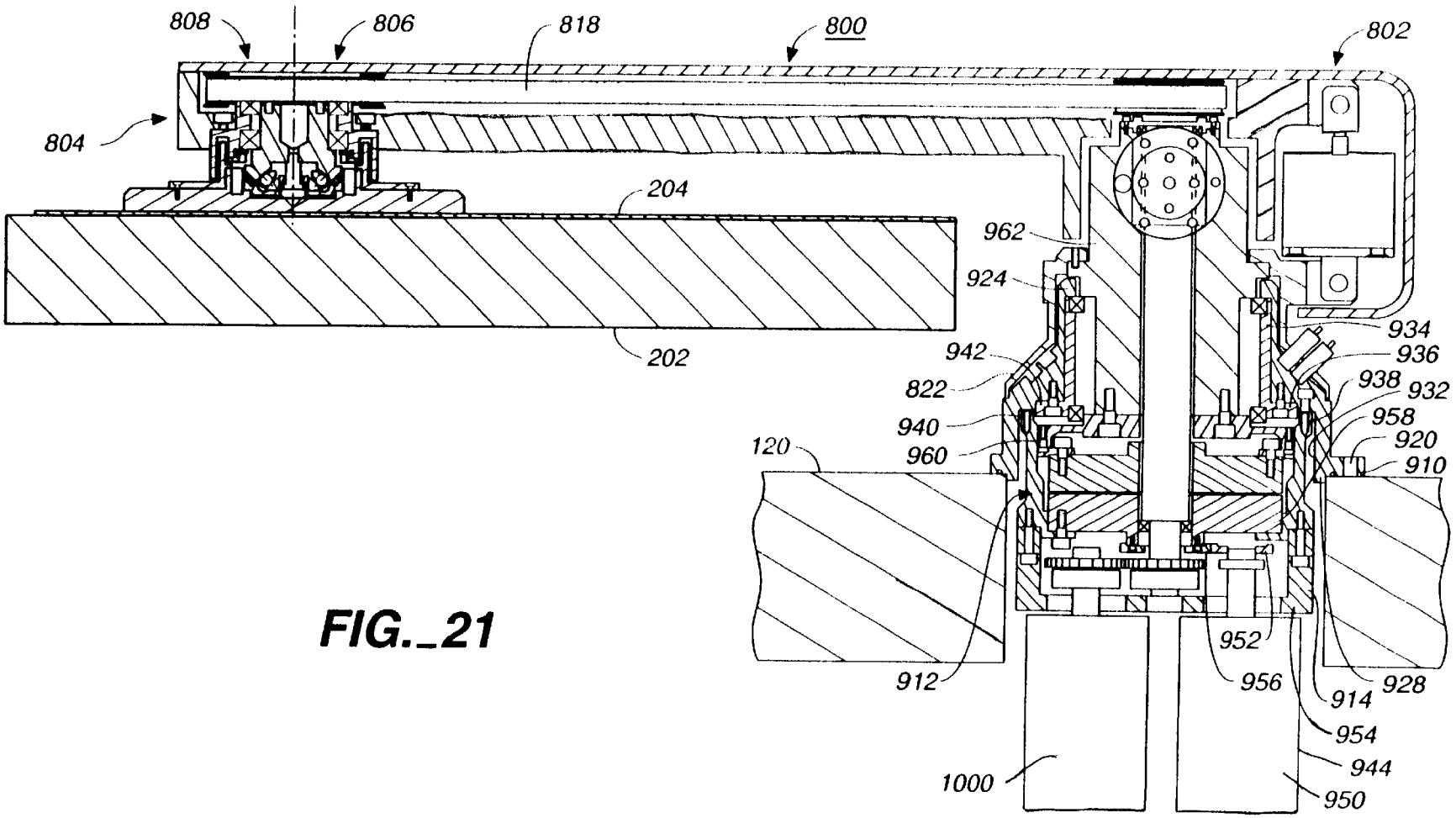
FIG. 21 is a side cross-sectional view of a conditioning apparatus usable with the invention.
Figure 22:
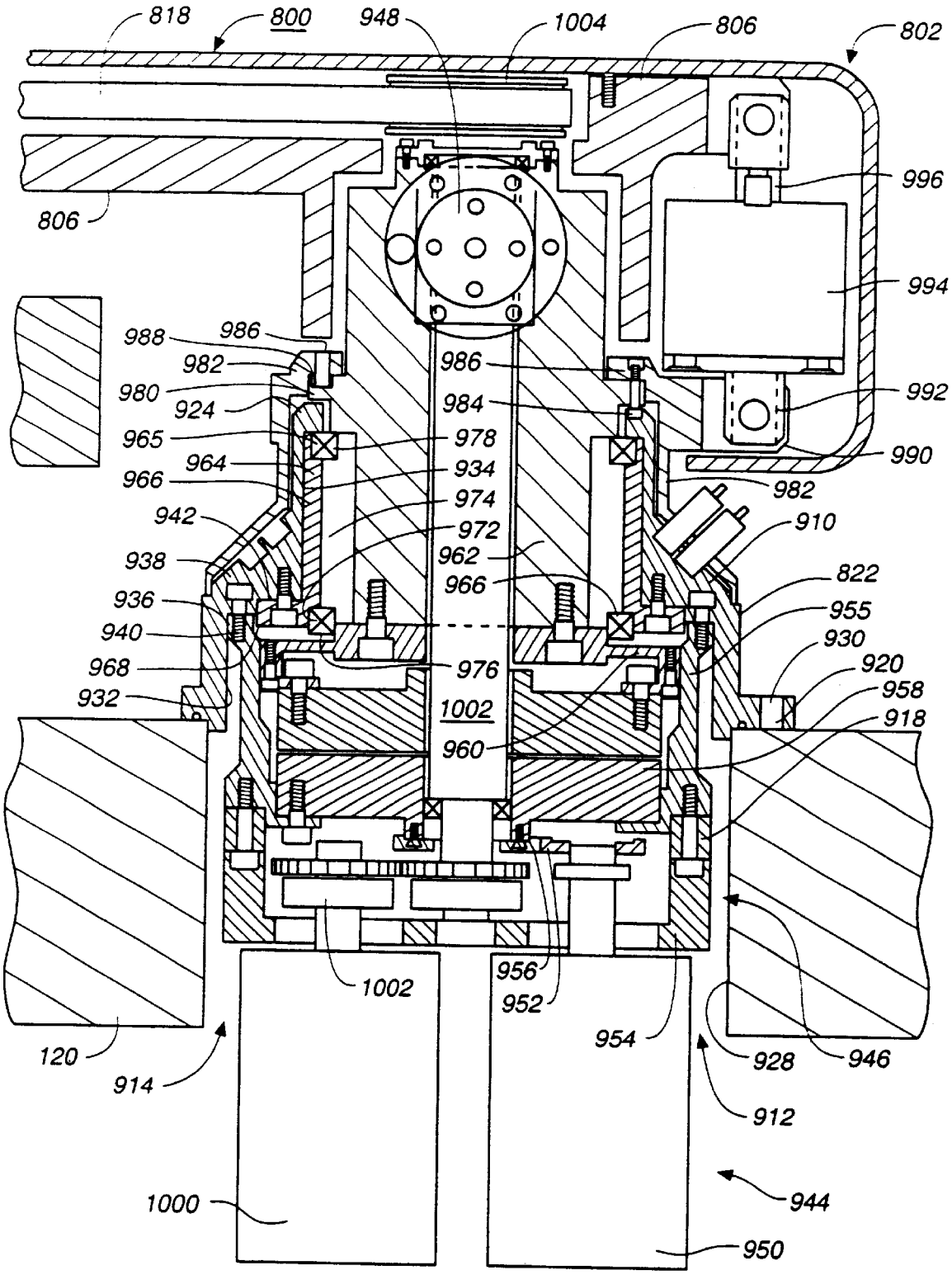
FIG. 22 is a side cross-sectional view of the support structure for the arm of the conditioning apparatus of FIG. 21.
Figure 23:
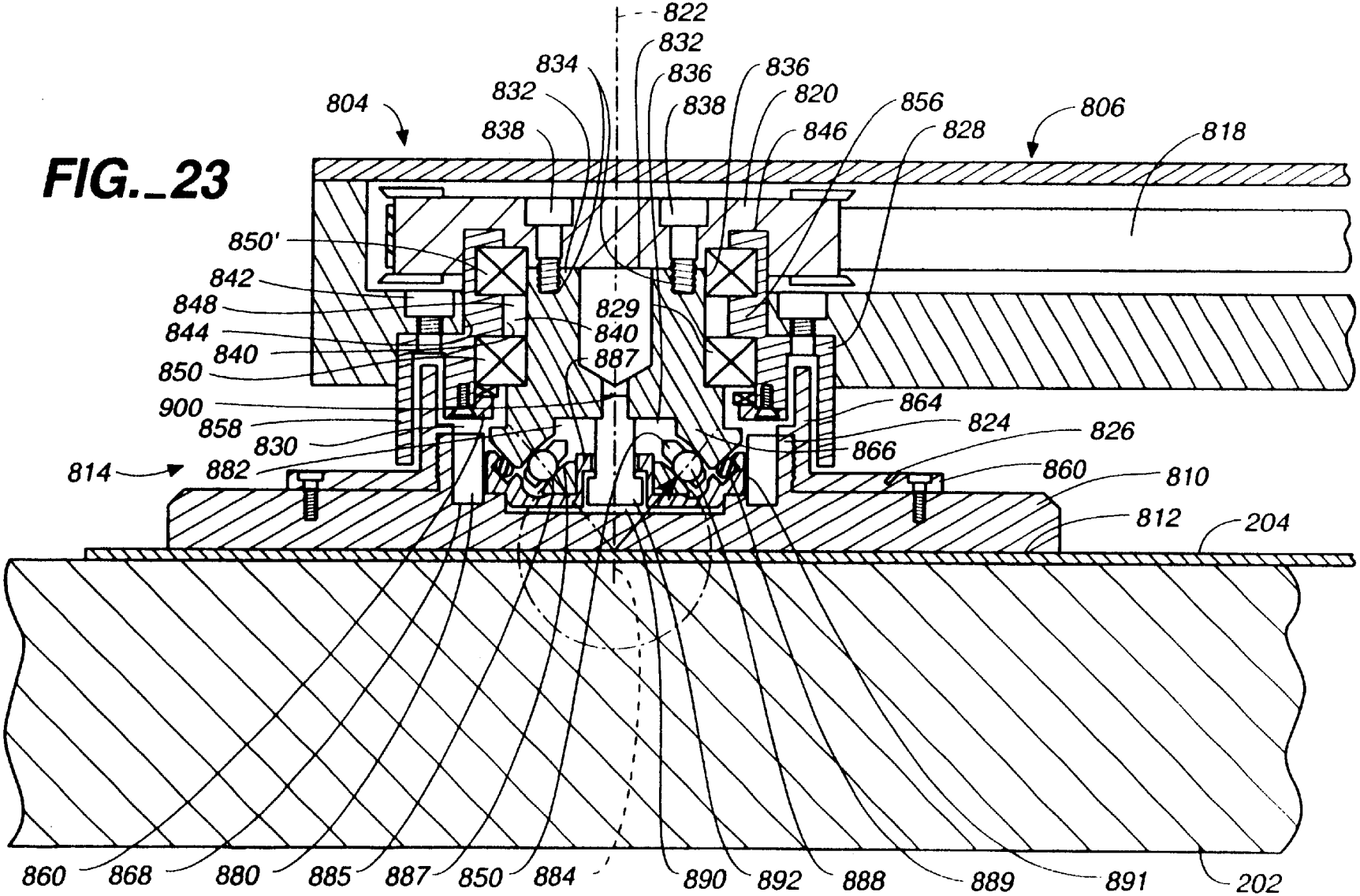
FIG. 23 is a side cross-sectional view of the conditioning head of the conditioning apparatus of FIG. 21.

Referring now to FIGS. 21, 22 and 23, there is shown the preferred configuration of the conditioning apparatus 800 for use with the polishing apparatus 100 of the present invention. The conditioning apparatus 800 generally includes a loading and positioning member 802, a conditioning portion 804 and a transfer arm 806, which extends between the conditioning portion 804 and the loading and positioning portion 802. To condition a polishing surface using the conditioning apparatus 800, the loading and positioning member 802 rotates horizontally the transfer arm 806 to position the conditioning member 804 suspended therefrom over the polishing surface, and, once positioned over the polishing surface, provides a downwardly directed force vector 808 at the end of the transfer arm 806 to push the conditioning member 806 against the polishing surface. The conditioning member 806 is also rotated in the vertical direction to place the conditioning member 806 in opposition to the polishing pad.

Referring now to FIG. 23, the preferred configuration of the conditioning member 804 is shown in detail. The conditioning member 804 includes a conditioning plate 810, having a lower planar conditioning surface 812, and a coupling 814 extending between the plate 810 and the transfer arm 806. The coupling 814 transfers rotary motion from a drive belt 818 and pulley 820 to the plate 810, but allows the plate to tilt about the axis of rotation 822 of the pulley 820.

The coupling 814 includes a central shaft 824, a capture ring 826 and a bearing support ring 828 which provide the rotational transfer and freedom of movement necessary for operation of the conditioning plate 810. The shaft 824 include a lower, annular, spherical surface 830, an upper face 832 having a plurality of bolt apertures 834 therein, and a bearing recess 836 extending partially between the upper face 832 and the spherical surface 830. To connect the pulley 820 to the shaft 824, a plurality of bolts 838 extend through apertures provided therefor through the pulley 820 and are received in the bolt apertures 834. To support the shaft 824 with respect to the transfer arm 806, the bearing support ring 828 extends through an aperture 840 in the transfer arm 806 and is retained thereto by a plurality of bolts 842. The bearing support ring 828, includes an inner circumferential face 844 and an upper, inwardly extending rim 846, which define a bearing receiving recess 848. A pair of bearings 850, 850' are located within this bearing receiving recess 848, and are spaced apart by an annular spacer ring 856. To secure the bearing in the bearing receiving recess 848, an annular retainer 858 is placed over the lower end of the bearing receiving recess 848, and a compressible spacer 860 is located between the lowermost bearing 850' and the retainer 858. The retainer 858 thus maintains the bearings 850, 850' within the bearing receiving recess 848. The inner races of the bearings 850, 850' are received on the bearing recess 836 of the shaft 824. The bearings allow the shaft 824 to rotate within bearing support ring 828, and thus within the transfer arm 806.

The capture ring 826 is used to capture the plate 810 on the shaft 824 while allowing sufficient vertical motion of the plate 810 with respect to the shaft 824 to allow the planar face 812 of the plate 810 to tilt with respect to the shaft 824. Preferably, the capture ring 826 includes a lower flange portion 860 which is connected to the upper surface of the conditioning plate 810 with a plurality of bolts, and an upwardly extending sleeve portion 864 having an inwardly projecting capture rim 864 projecting from the hollow interior thereof. The shaft 824 includes an outwardly projecting capture flange 866, over which the capture rim 864 rides. During normal polishing operations, the capture rim 864 does not contact the capture flange 866. However, when the transfer arm 806 is used to move the plate 810 on or off the polishing surface, the movement of the capture flange 866 upwardly from the polishing surface engages the capture flange 866 against the capture rim 864 to lift the capture ring 826 and the plate 810 attached thereto off the polishing surface.

To transfer rotational motion from the shaft 824 to the conditioning plate 810, the conditioning plate 810 includes at least one pin aperture 868 therein, in which a pin 880 is partially received. The capture flange 866 includes a pin aperture 882 therein, having a diameter slightly larger than the outer diameter of the pin 880. As the shaft 824 rotates, it swings the pin aperture 882 and thus the pin 820 through a circular path, to rotate the plate 810 about the axis of rotation 822.

To enable variable polar positioning of the plate 810 relative to the shaft 824, the upper surface of the conditioning plate 810 farther includes a central recess therein, within which is received an insert 885 having a semi-spherical projecting surface 887. The projecting surface 887 has a spherical radius equal to the distance between the projecting surface 887 and the intersection of the interface between the conditioning plate 810 and the polishing pad 204 with a centerline 884 of the plate conditioning 810. Preferably, this semi-spherical projecting surface 887 is an annular segment of a sphere, which is provided by a semi-spherical, annular second insert 889 which is received within a recess provided therefor at the center of the insert 885. A plurality of caged balls 888 (only two shown) are located between the semi-spherical projecting surface 887 and the spherical surface 830 on the lower end of the shaft 824. The balls form a bearing surface which allows the plate to move relative to the shaft about a point defined at the aforementioned intersection of the centerline 884 and of the base 812 of the plate 810 as the plate 810 encounters high of low spots on the polishing surface. Thus, as the conditioning plate 810 tilts, the base 812 of the plate 810 remains substantially parallel to the upper surface of the polishing surface, and thus one portion of the edge of the plate will not dig into the surface of the polishing surface as high and low spots are encountered by the conditioning plate 810. A compliant O-ring 889 is set in an annular recess between the insert 885 and the capture flange 866 of the shaft 824 to provide increasingly strong resistance to increasing tilt of the conditioning plate 810. Preferably, the insert 885 includes a central bore 890 therein, within which the head of a bolt 892 is received. The bore 890 also includes an inwardly projecting annular lip, which traps the head 894 of the bolt 892 within the bore 890, and the shaft of the bolt 892 is threaded into a central threaded bore in the shaft 824. The bolt 892 retains the insert 885 on the shaft 824. However, the head of the bolt 892 is smaller than the bore 890 in the insert 885, and therefore the insert may move substantially with respect to the bolt 890 to allow the plate to tilt with high and low spots on the polishing surface.

The Loading/Positioning Assembly

Referring now to FIG. 22, the details of the loading/positioning assembly 802 are shown. The loading/positioning assembly 802 generally includes a mount 910, which is received on the apparatus cover and provides a grounded reference surface, a transfer arm positioning assembly 912 and a shaft rotation assembly 914. The transfer arm 806 is received on the loading/positioning assembly 802 to enable positioning of the conditioning member 810 on the polishing surface and biasing of the conditioning member 810 against the polishing surface.

The mount 910 is a hollow cylindrical sleeve having a lower annular mounting flange 920 at its lower terminus, a contoured outer cylindrical face 822 extending upwardly from the mounting flange 920, and an upper inwardly extending bearing flange 924. The mount 910 is received over a conditioning arm aperture 928 in the apparatus table top 120, and it includes a downwardly extending pilot portion, which forms an inner guide which is securely sleeved into the upper terminus of the conditioning aperture 928. This ensures secure positioning of the mount 910 on the table top 120. The mounting flange 920 also includes a plurality of pilot holes 930 (only one shown) therethrough, through which bolts (not shown) extend into apertures (not shown) provided therefore in the table top 120 to secure the flange 920 to the table top 120.

The interior cylindrical surface of the mount 910 includes a lower, inwardly facing circumferential face 932, an upper, inwardly facing circumferential face 934, and a pair of annular recesses 936, 938. These annular recesses include first and second inverted annular mounting surfaces 940, 942 from which the transfer arm positioning assembly 912 and the shaft rotation assembly 914 are suspended.

The transfer arm positioning assembly 912 generally includes a drive apparatus 944 which is coupled to a drive system 946 which terminates in a rotary coupling 948 rotatably connected to proximal end of the transfer arm 806. In the preferred embodiment, the drive apparatus 944 includes a drive motor 950, having a gear 952 output, which is suspended from a hanger 954 attached to the first inverted annular mounting surface 940. The hanger 954 is preferably connected to the first inverted annular mounting surface 940 through an extension sleeve 955 which is bolted to the first inverted annular mounting surface 940. The gear 952 is meshed with flywheel gear 956 located on a harmonic drive 958, which is coupled, through a support web structure 960, to a transfer shaft 962.

The support web structure 960 and the transfer shaft 962, a bearing support sleeve 964 is received over the outer surface of the transfer shaft 962, and this sleeve 964 includes an upper bearing pilot 965, a lower bearing pilot 966 and an outwardly extending mounting flange 968. The mounting flange 968 is received within the annular recess 936, and is secured on the second inverted annular mounting surface 942. The support web structure 960 includes a lower annular bearing recess 972 adjacent the perimeter of the connection of the support web structure 960 and the shaft 962, and the shaft 962 includes a shaft bearing recess 974 located adjacent to the upper terminus of the sleeve 964. An upper roller bearing 978 extends between the shaft bearing recess 974 of the shaft 962 and the upper bearing pilot 965 of the sleeve 964, and a lower roller bearing 976 extends between the annular bearing recess 972 of the web structure and the lower bearing pilot 966 of the sleeve 964. The bearings 976, 978 provide radial stability to the shaft 942 as the shaft is rotated and as the conditioning plate 810 is loaded against the polishing pad 204.

To transfer rotational motion of the transfer shaft 962 to the transfer arm 806, the shaft 962 includes a annular transfer rim 980 extending radially outwards from its middle. A transfer arm cover plate 982 is received over the transfer rim 980, and is secured thereto by a bolt 984 which extends through a hole 986 in the transfer arm cover plate 982 into a threaded aperture in the transfer rim 980 which is located through the flange at a position on the transfer ledge 980 which is directly opposite the nominal position of the conditioning plate 810 on the polishing surface. Additionally, to align the transfer arm cover plate 982 on the transfer rim 980, a plurality of pins 986 extend from the cover plate 982 and into clearance bores 988 in the transfer ledge 980. The cover plate 980 also includes a pivot flange 990 extending therefrom, over which a yoke 992 of a pneumatic piston housing 994 is received. A pneumatic piston rod 996 extends upwardly from the piston housing 994 and is rotatably coupled to the transfer arm 806. By varying the extension of the piston rod 996 from the housing 994, the bias or load of the conditioning member 802 on the polishing surface can be varied. Additionally, by fully retracting the rod 996 into the housing 994, the conditioning member 802 may be lifted from the polishing surface.

Preferably, the transfer arm cover plate 982 rotates the transfer arm 806 and the conditioning member 802 over the entire circumference of the transfer rim 980. When the conditioning member 802 is pressed on the polishing surface, the center of inertia of the transfer arm 806 is maintained substantially co-linearly with the center of rotation of the transfer shaft 862.

By operating the drive motor 950, the gear 952 horizontally rotates the transfer shaft 962 through the torque-increasing harmonic drive 958 and thereby moves the conditioning plate 810 of conditioning member 802 through an arc centered on the center of rotation of the transfer shaft 962. The motor can be moved through a path along an arc sufficient to sweep the conditioning plate 810 across the polishing surface, and then reversed, to move the conditioning surface through a reverse path along the arc. Thus, the conditioning plate 810 may be repeatedly swept back and forth along the surface of the polishing surface to condition the pad. Additionally, when the conditioning member 802 is removed from the polishing surface, the motor 950 is operated to sweep the conditioning member 802 to the side of the polishing surface.

Referring still to FIG. 22, the shaft rotation assembly 914 rotates the conditioning member 802 in a horizontal plane in juxtaposition to the polishing pad 204. Preferably, the rotation assembly 914 includes a conditioning plate drive motor 1000 which is held by the hanger 954, and a conditioning plate drive shaft 1002 which is coupled to the conditioning plate drive motor through gears and which extends upwardly through a bore through the middle of the support web structure 960 and the transfer shaft 962 wherein it terminates above the transfer shaft 962 in a horizontally rotating pulley 1004. Importantly for the self-tensioning, the pulley 1004 is positioned above the rotary coupling 948. The drive belt 818 extends between the pulley 1004 and the sheave 820 about the conditioner head to transfer rotational output of the conditioning plate drive motor 1000 to the conditioning plate 810.

As the conditioning plate 810 is positioned on the polishing surface and rotated with respect thereto, the lower, i.e., conditioning, surface 812 of the plate will encounter glazed and unglazed regions of the polishing surface. The structure of the conditioning apparatus 800 uniquely provides inherent variable loading of the conditioning plate lower surface 812 against the polishing surface in response to changes in the polishing surface condition, which are manifested as changes in coefficient of friction at the interface between the plate lower surface 812 and the polishing surface interface. Specifically, as the conditioning plate 810 rotates on the polishing surface of the pad 204, a coefficient of friction is present at the interface of the plate lower surface 812 and the polishing surface. As glazed portions of the polishing surface are encountered by the plate 810, the coefficient of friction at the interface decreases. This decrease in coefficient of friction reduces the torque needed to drive the plate 810 at a constant velocity, causing the tension in the belt 818 to decrease. This decrease in tension is transferred, as a reduced force vector, at the coupling of the belt 818 to the drive pulley 1004. Because this force vector is transferred to the conditioning plate drive shaft 1002 at a distance equal to the displacement to the pulley 1004, the force vector change creates a moment on the end of the shaft 1002 tending to increase the load of the conditioning plate 810 against the polishing surface. Likewise, when the plate 810 moves from glazed to unglazed portions of the conditioning surface, the coefficient of friction between the plate 810 and the polishing surface increases, increasing the tension on the belt and thereby creating a moment on the drive shaft 1002 tending to decrease the loading of the plate 810 against the polishing surface.

The Alternative Carousel Configuration

In the above-described embodiment of the apparatus, the carousel provides a hard connection between the two wafer heads 602, 602', i.e., the two heads 602, 602' may not be moved relative to one another. However, process efficiency would be increased if the wafer head 602 (or 602') is continuously swept in an arc on the polishing surface 204 or 304 even during loading and unloading of the other wafer head. However, where the wafer heads 602 and 602' are rigidly interconnected, substrate loading and unloading from and to a moving head becomes problematic. Either a very complex loading and unloading apparatus must be provided to move with the wafer head 602 (or 602') being loaded or unloaded as the wafer head 602' (or 602) polishes a different substrate and sweeps it in the arcuate path across the polishing surface 204, or the wafer heads must remain stationary during the load and unload cycle. Therefore, as will be further described herein, the carousel may be configured to maintain one of the wafer heads stationary over the load/unload station 400 while allowing the other head to be arcuately swept on the polishing surface 204 or 304. The same mechanisms can be extended to first do a short, fine polish at polishing station 300 and then unload the wafer from the same wafer head 602 while the second wafer head 602' continues a rough polish at polishing station 200.

Referring to FIGS. 24 through 28, there are shown three different alternative embodiments of the carousel which will provide stationary positioning of one of the heads while the other of the heads is swept over the polishing surface 204.

Figure 24:
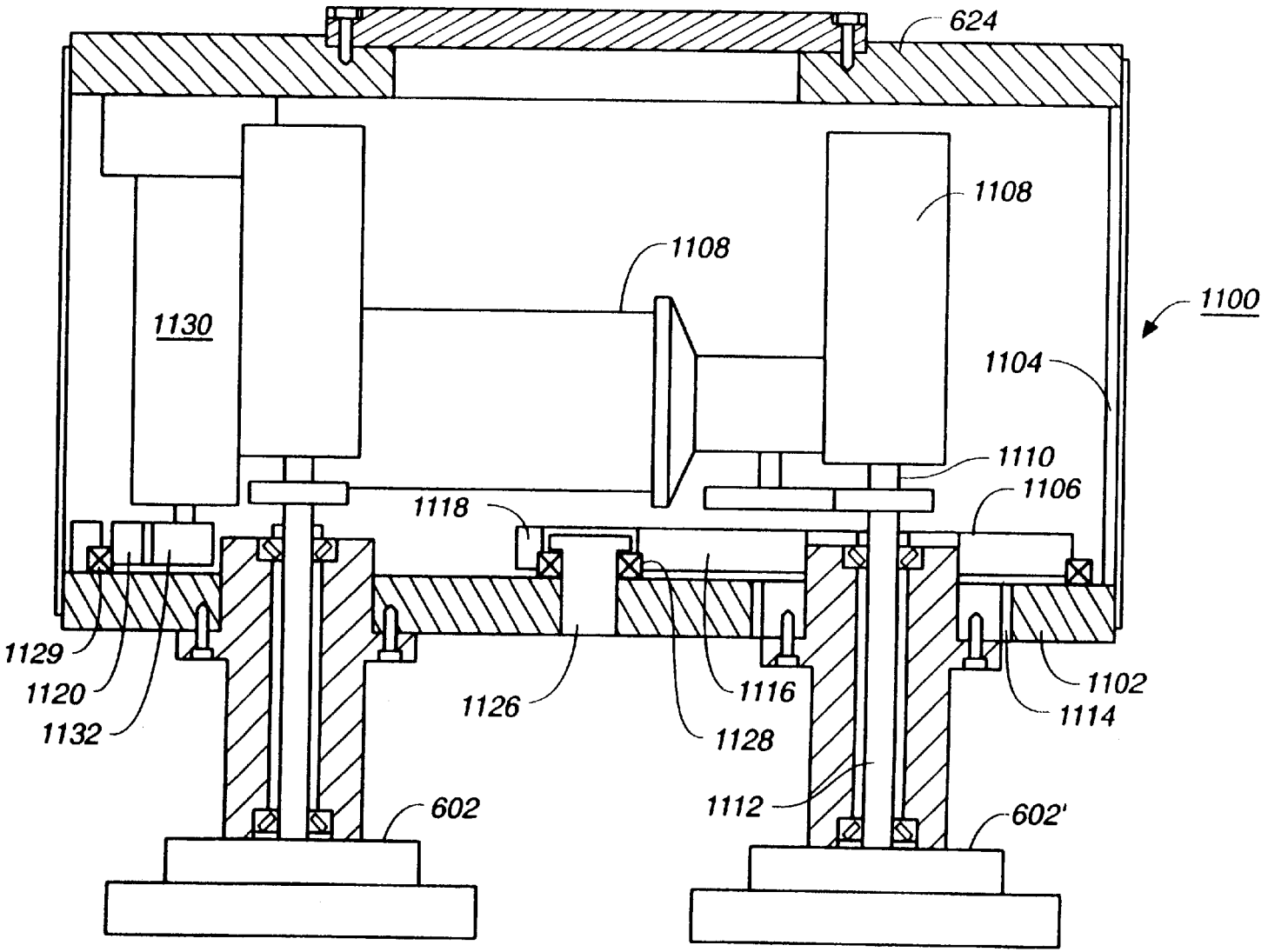
FIG. 24 is a first alternative embodiment of the carousel of the invention.
Figure 25:
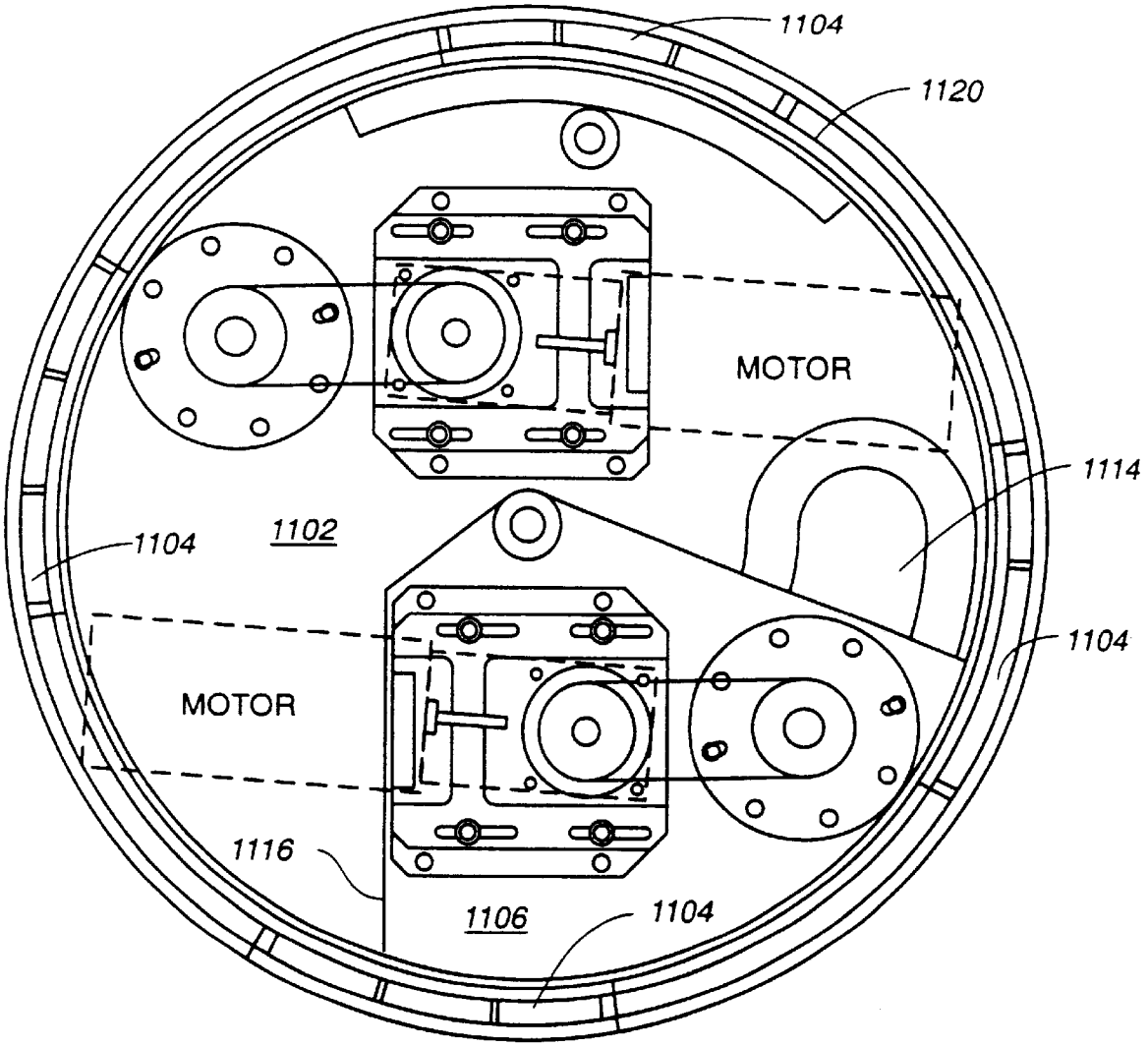
FIG. 25 is a plan view of the carousel of FIG. 24.

Referring first to FIGS. 24 and 25, the first alternative carousel 1100 includes the carousel plate 624, from which a plurality of hanging posts 1104 suspend a lower, slotted, plate 1102. The wafer head 602 is fixedly suspended from the lower, slotted plate 1102 as in the previously described embodiment of the carousel. However, the wafer head 602' is independently suspended from a slide plate 1106, on which the second head drive motor 1108 and second head drive coupling 1110 are also mounted. The wafer head drive shaft 1112 for the head 602', which extends downwardly from the slide plate 1102, extends through an arcuate slot 1114 in the slide plate 1102. By moving the drive shaft 1112 along the slot 1114, the wafer head 602 may be swept through an arc as the wafer head 602 remains stationary for loading and unloading of substrates.

To provide the sweeping motion, the sweep plate 1106 includes an arcuate segment 1116 from which the wafer head 602' is suspended, an alignment bore 1118 which is positionable at the center of the lower plate 1102, and a partial annular geared ring 1120 which extends from opposite sides of the arcuate segment 1116 and generally above, and coextensive with, the outer circumference of the lower plate 1102. A segment shaft 1126 extends upwardly from the center of lower plate 1102, and is there received within the alignment bore 1118. A sweep bearing 1128 connects the segment shaft 1126 to the arcuate segment 1116 at the alignment bore 1118 to enable rotation of the segment 1116 about the segment shaft 1126.

To support the segment 1116 and the ring 1120, a bearing 1129 extends circumferentially at the radius of the ring 1120 between the ring 1120 and segment 1116 and the lower plate 1104. The bearing supports the mass of the sweep plate 1106 and the wafer head drive components (i.e., the second head drive motor 1108 and second head drive coupling 1110) on the lower plate 1102 while allowing relative movement therebetween. To provide this movement, a segment drive motor 1130 is suspended from the carousel plate 624, and the output shaft thereof includes a pinion gear 1132 which is meshed to the geared ring 1120. By rotating the pinion gear 1132, the geared ring 1120 is moved arcuately, thereby moving the ring 1120, and the segment 1106, in a circular path about the segment shaft 1126. The motor 1130 rotates the pinion gear 1132 in one direction, and then reverses the direction, to sweep the wafer head 602' back and forth in an arcuate path as the carousel otherwise remains stationary to allow a substrate to be removed from, and loaded into, the wafer head 602.

Figure 26:
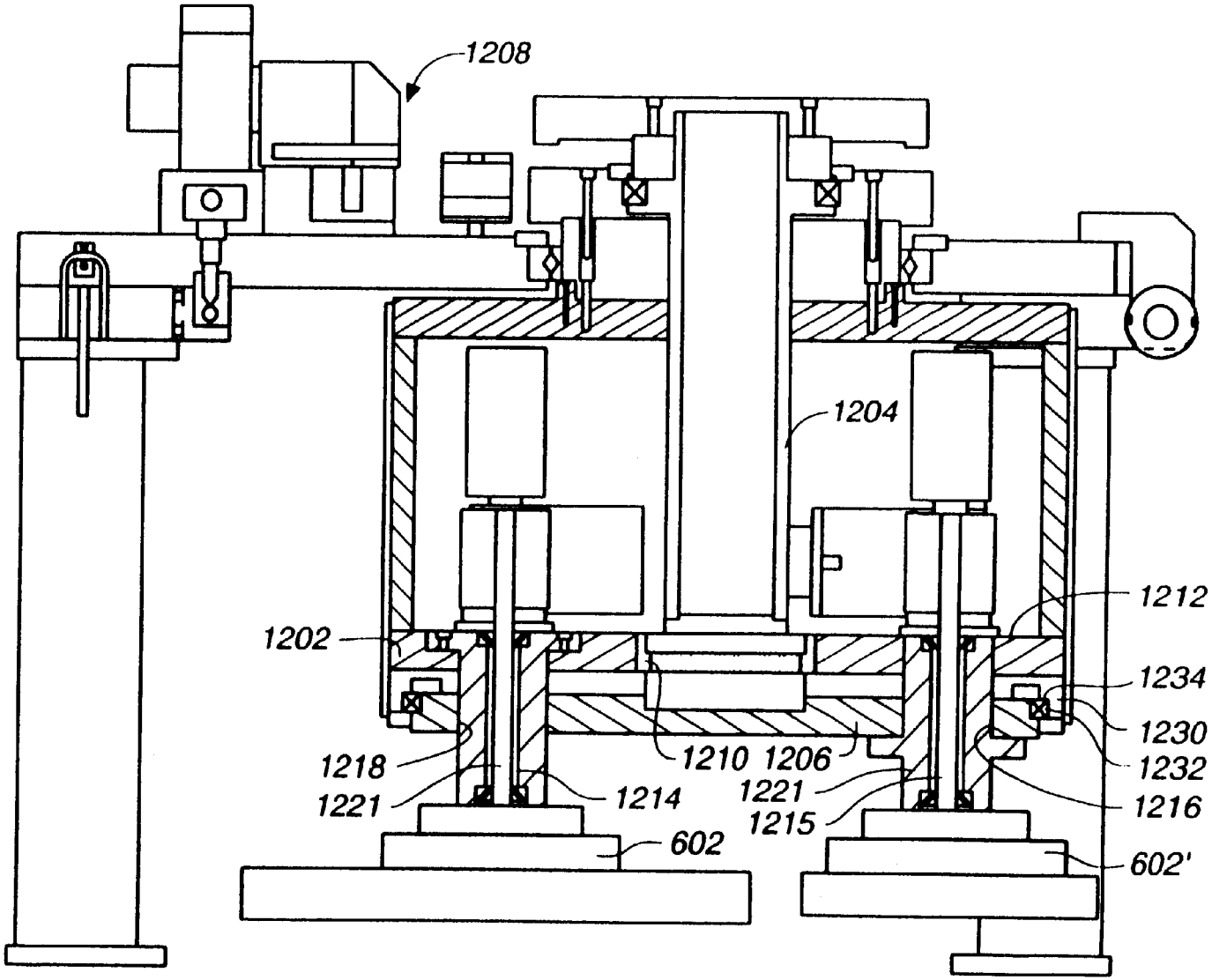
FIG. 26 is a second alternative embodiment of the carousel of the invention.

Referring now to FIG. 26, there is shown a second alternative embodiment of the carousel. This alternative carousel 1200 includes a modified lower plate 1202 through which a secondary drive shaft 1204 into engagement with a secondary lower plate 1206, and a secondary drive system 1208 for sweeping the secondary lower plate 1206 through a defined arc.

The modified lower plate 1202 includes a central clearance aperture 1210 therethrough, through which the secondary drive shaft housing 1204 loosely extends, and arcuate slot 1212 through which the a wafer head drive shaft housing 1214 loosely extends. The drive shaft housing 1214 encloses a drive shaft 1215. A secondary lower plate 1206 includes a wafer head drive shaft aperture 1216 through which the polishing head drive shaft housing 1214 extends and an arcuate slot 1218 through which another drive shaft housing 1220 extends. The drive shaft housing 1214 is fixed to the underside of the secondary lower plate 1206. The other drive shaft housing 1220 encloses a drive shaft 1221 for rotating the wafer head 602. The modified lower plate 1202 is connected to the lower end of the secondary drive shaft 1204, which is rotated, by the secondary drive system 1208, to rotate the modified lower plate 1206 through an arc equal to the arcuate length of the slots 1212, 1218.

To support the modified lower plate 1202, a support sleeve 1230, having a bearing recess 1232 therein, extends downwardly from the perimeter of the modified lower plate 1206. A roller bearing 1234, which extends about the circumference of the bearing recess 1232, is received in the recess 1232. The inner race of the bearing 1234 rides in this recess. The bearing 1234 enables relative rotational motion between the two plates 1202 and 1204.

Figure 27:
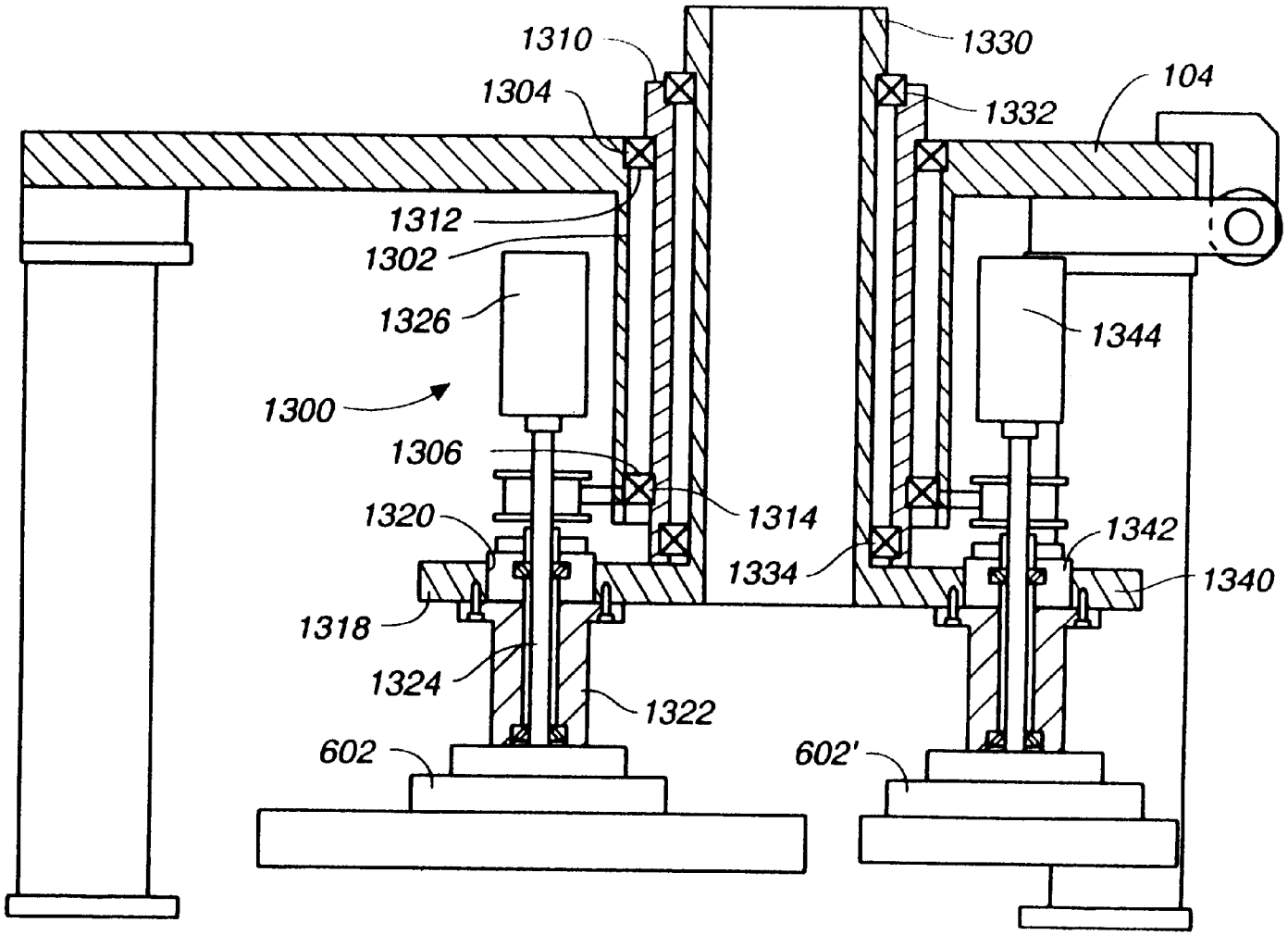
FIG. 27 is a third alternative embodiment of the carousel of the invention.
Figure 28:
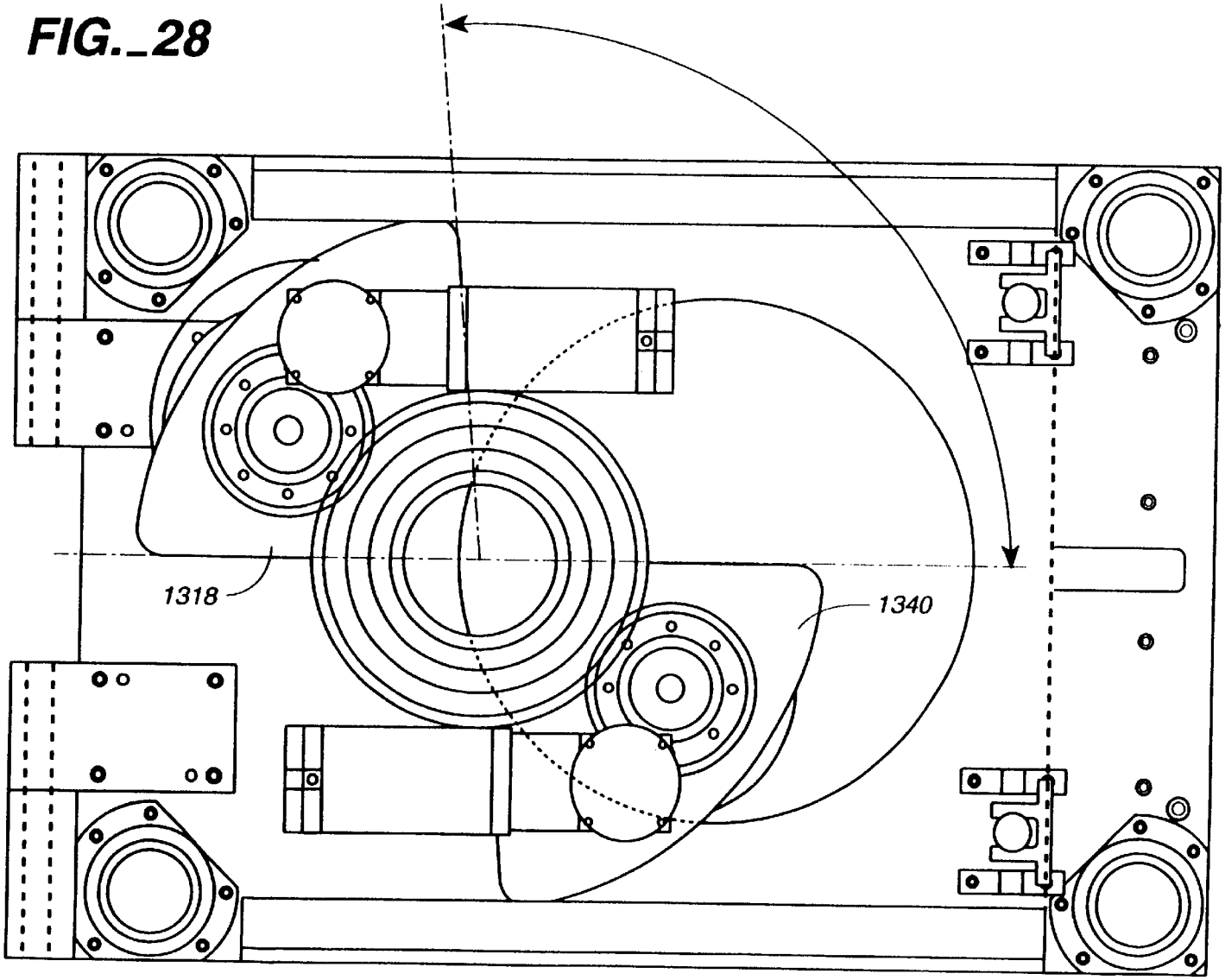
FIG. 28 is a plan view of the carousel of FIG. 27.

Referring now to FIGS. 27 and 28, a third alternative construction for positioning the wafer heads 602, 602' is shown. In this embodiment, the carousel is eliminated, and the wafer heads 602, 602' are coupled to hanger apparatus 1300 which extends downwardly from the overhead platform 104. Preferably, the hanger apparatus 1300 includes a support sleeve 1302 extending downwardly from the overhead platform 104. The sleeve 1302 includes an upper bearing bore 1304 and a lower bearing bore 1306 located at the ends of the sleeve 1302. A first, hollow, drive shaft 1310 is supported within the support sleeve 1302 on bearings 1312, 1314 which are received in the bearing bores 1304, 1306. The lower end of the sleeve 1302 supports an outwardly extending support segment 1318, which is a planar segment of steel plate, having a bore 1320 extending therethrough. A wafer head support sleeve 1322, through which the wafer head drive shaft 1324, is supported on bearings, extends through the bore 1320, and is to the segment 1318. A drive motor 1326 is supported on the support segment 1318 to rotate the drive shaft 1324 to thereby rotate the wafer head 602.

An inner drive shaft 1330 extends through the first hollow drive shaft 1310, and is supported therein on bearings 1332, 1334. The ends of the inner shaft 1330 extend beyond the ends of the outer shaft 1310. At the lower end of the inner shaft 1330, a second outwardly extending support segment 1340, which is a planar segment of steel plate, having an offset bore 1342 extending therethrough, is received. The second outwardly extending support segment 1340 positions the second wafer head 602' by positioning the support sleeve therefor through the bore 1342 and supporting a second drive motor 1344 thereon. The upper ends of the shafts 1310, 1330 are preferably coupled to separate drive motors (not shown), such as by belts, pulleys, gears or direct shafting. These motors provide the positioning of the wafer heads 602, 602' at the polishing stations 200, 300 and at the load/unload station 400.

Although the system has been described in terms of polishing semiconductor wafers, the term wafer can be used in the larger sense of any workpiece having a planar surface on at least one side thereof that requires polishing. Indeed, the workpiece need not be substantially circular as long as the wafer head is adapted to received a non-circular workpiece.

Although the invention has been described in terms of an integrated polishing apparatus, each of the subsystems may be used independently of the other sub-systems to provide their intended function The invention thus provides an integrated polishing system capable of high throughput of polished wafers. The polishing may be accomplished by a multistage process including multiple grades of polishing as well as washing.

What is claimed is:

1. An apparatus for polishing a substrate, comprising:

a first platen rotatable about a first axis supporting a first polishing surface having a first diameter;

a second platen rotatable about a second axis supporting a second polishing surface having a second diameter that is different than the first diameter;

a carousel rotatable about a third axis;

a first wafer head assembly suspended from said carousel to hold a first wafer; and a positioning member coupled to said carousel to rotate said carousel about said third axis and thereby position said wafer head assembly at one of a plurality of positions equally angularly spaced about the third axis, the plurality of positions including a first position over the first polishing surface, a second position over the first polishing surface, and a third position over the second polishing surface.

2. The apparatus of claim 1, wherein said second diameter is larger than said first diameter.

3. The apparatus of claim 1, wherein said first polishing surface has a different polishing characteristic than said second polishing surface.

4. The apparatus of claim 1, wherein said positioning member causes said carousel to oscillate said wafer head assembly in an arcuate path over one of said first and second polishing surfaces during polishing.

5. The apparatus of claim 1, wherein the plurality of positions includes a fourth position, and wherein the polishing apparatus further comprises an unloading station at said fourth position.

6. The apparatus of claim 4, wherein said arcuate path is a circular path having a center at said third axis.

7. The apparatus of claim 1, further comprising a second wafer head assembly suspended from said carousel.

8. The apparatus of claim 7, wherein said first and second wafer head assemblies are supported from the carousel in fixed angular positions relative to each other.

9. The apparatus of claim 7, wherein said carousel comprises said first and second wafer head assemblies are supported from the carousel such that their angular positions can change relative to each other.

10. The apparatus of claim 9, wherein said carousel comprises:

a first rotatable member supporting said first wafer head assembly and rotatable about the third axis; and a second rotatable member having a first end and a second end, the second rotatable member supporting said second wafer head assembly at said first end and supported from the first rotatable member at said second end, said second rotatable member rotatable about a fourth axis offset from said third axis.

11. A polishing apparatus, comprising:

a first platen to support a first polishing pad, the first platen having a first diameter;

a second platen to support a second polishing pad, the second platen having a second diameter, wherein said first diameter is substantially larger than said second diameter;

a carousel rotatable about an axis;

a first wafer head suspected from the carousel to hold a wafer; and a positioning member coupled to said carousel to rotate said carousel about said axis and thereby position said wafer head at one of a plurality of positions equally angularly spaced about the axis, the plurality of positions including a first position over the first polishing surface, a second position over the first polishing surface, and a third position over the second polishing surface.

12. The polishing apparatus of claim 11, further comprising a second wafer head, wherein said first and second wafer heads are held by said carousel at respective points such that, in a first rotational position of said carousel said first wafer head overlies a first polishing position of said first platen and said second wafer head overlies said second platen, and in a second rotational position of said carousel said first wafer head overlies a second polishing position of said first platen.

13. The polishing apparatus of claim 11, further comprising a second wafer head, wherein said first and second wafer heads are held by said carousel at respective points such that, in a first rotational position of said carousel said first and second wafer heads overlie said first platen, and in a second rotational position of said carousel said first and second wafer heads overlies different ones of said first and second platens.

14. A polishing method, comprising:

mounting a wafer to a wafer-holding head suspended from an assembly;

rotating said assembly about an axis to move said head sequentially between a plurality of positions equally angularly spaced about the axis, the plurality of positions including a first position over a first polishing surface, a second position over said first polishing surface, and a third position over a second polishing surface;

polishing the wafer at the first and second polishing surfaces; and unmounting said wafer from said head after said wafer has been sequentially processed by said first and second polishing surfaces.

15. The polishing method of claim 14, wherein the plurality of positions includes a fourth position, and said unmounting step occurs at said fourth position.

16. The polishing method of claim 14, further comprising oscillating said assembly so as to sweep said head over one of said first and second polishing surfaces during polishing.

17. The polishing method of claim 14, further comprising mounting another wafer to another wafer-holding head during the steps of polishing said wafer.

18. An apparatus for polishing a-substrate, comprising:

a first polishing surface;

a second polishing surface;

a wafer head to hold a wafer;

an assembly to support the wafer head; and a positioning member coupled to said assembly to move the wafer head between a plurality of positions equally angularly spaced about an axis, the plurality of positions including a first position over the first polishing surface, a second position over the first polishing surface, and a third position over the second polishing surface.

19. The apparatus of claim 18, wherein the plurality of positions includes a fourth position, and wherein the polishing apparatus further comprises an unloading station at said fourth position.

20. The apparatus of claim 18, further comprising a first platen to support the first polishing surface and a second platen to support the second polishing surface.

21. The apparatus of claim 18, wherein the first polishing surface has a first dimension, the second polishing surface has a second dimension, and the first dimension is larger than the second dimension.

22. The apparatus of claim 18, wherein the first and second polishing surfaces are circular, and the first polishing surface has a first diameter larger than a second diameter of the second polishing surface.

* * * * *